US011795403B2

(12) United States Patent
Singh et al.

(10) Patent No.: US 11,795,403 B2
(45) Date of Patent: Oct. 24, 2023

(54) FREE FATTY ACID SEPARATION AND RECOVERY USING RESIN

(71) Applicant: THE BOARD OF TRUSTEES OF THE UNIVERSITY OF ILLINOIS, Urbana, IL (US)

(72) Inventors: Vijay Singh, Savoy, IL (US); Ramkrishna Singh, Urbana, IL (US)

(73) Assignee: THE BOARD OF TRUSTEES OF THE UNIVERSITY OF ILLINOIS, Urbana, IL (US)

( * ) Notice: Subject to any disclaimer, the term of this patent is extended or adjusted under 35 U.S.C. 154(b) by 0 days.

(21) Appl. No.: 17/828,955

(22) Filed: May 31, 2022

(65) Prior Publication Data

US 2022/0403257 A1 Dec. 22, 2022

Related U.S. Application Data

(60) Provisional application No. 63/194,571, filed on May 28, 2021.

(51) Int. Cl.

| | |
|---|---|
| ***C10G 25/02*** | (2006.01) |
| ***C10G 25/12*** | (2006.01) |
| ***C10G 25/00*** | (2006.01) |

(52) U.S. Cl.

CPC ..... *C10G 25/02* (2013.01); *C10G 25/006* (2013.01); *C10G 25/12* (2013.01); *C10G 2300/1007* (2013.01); *C10G 2300/201* (2013.01); *C10G 2300/4081* (2013.01)

(58) Field of Classification Search

None

See application file for complete search history.

(56) References Cited

U.S. PATENT DOCUMENTS

| | | | | |
|---|---|---|---|---|
| 2,771,480 | A * | 11/1956 | Chasanov | C11D 19/00 554/185 |
| 4,125,550 | A * | 11/1978 | Schoenenberger | C11B 3/10 502/25 |
| 8,097,049 | B2 | 1/2012 | Munson et al. | |
| 10,557,155 | B2 | 2/2020 | Wawrousek et al. | |
| 2008/0271364 | A1 | 11/2008 | Wiesman et al. | |
| 2010/0210861 | A1 | 8/2010 | Woods et al. | |
| 2013/0149757 | A1 | 6/2013 | Day et al. | |
| 2015/0267134 | A1 | 9/2015 | Sanchez-Riera et al. | |

FOREIGN PATENT DOCUMENTS

JP 2016059833 A 4/2016

OTHER PUBLICATIONS

Al-Asheh et al., "A Comprehensive Method of Ion Exchange Resins Regeneration and Its Optimization for Water Treatment", Department of Chemical Engineering, American University of Sharjah, Sharjah, UAE, Published: Aug. 12, 2020, 13 pages.

Deboni et al., "Deacidification of Soybean Oil by Ion Exchange", Food Bioprocess Technol, Published online: Dec. 19, 2012, pp. 3335-3344, Springer Science+Business Media, New York, 2012.

Eregowda et al., "Volatile fatty acid adsorption on anion exchange resins: kinetics and selective recovery of acetic acid", Separation Science and Technology, 2020, vol. 55, No. 8, pp. 1449-1461, DOI: 10.1080/01496395.2019.1600553.

Jamal et al., "Separation of Oleic Acid from Soybean Oil Using Mixed-Bed Resins", Journal of Chemical & Engineering Data, vol. 55, No. 7, Feb. 2010, pp. 2405-2409.

Maddikeri et al., "Adsorptive Removal of Saturated and Unsaturated Fatty Acids Using Ion-Exchange Resins", Ind. Eng. Chem. Res. Apr. 27, 2012, 51, pp. 6869-6876.

Gnanaprakasam et al., "Recent Strategy of Biodiesel Production from Waste Cooking Oil and Process Influencing Parameters: A Review", Journal of Energy, May 22, 2013, vol. 2013, Article 926392, 11pgs.

Mandolesi De Araujo et al., "Biodiesel production from used cooking oil: A review", Abstract, Nov. 2013, Renewable and Sustainable Energy Reviews, vol. 27, pp. 445-452.

Otadi et al., "Reduction of Free Fatty Acids of Waste Oil by Acid-Catalyzed Esterification", Procedia Engineering, Nov. 26, 2011, vol. 18, pp. 168-174.

Turkay et al., "Deacidification of Sulfur Olive Oil. I. Single-Stage Liquid-Liquid Extraction of Miscella with Ethyl Alcohol", JAOCS, Feb. 1991, vol. 68, No. 2, pp. 83-86.

* cited by examiner

*Primary Examiner* — Renee Robinson

(74) *Attorney, Agent, or Firm* — Haukaas Fortius PLLC; Michael Haukaas

(57) ABSTRACT

The disclosure provides various methods for separating and recovering free fatty acids crude oil containing free fatty acids using certain ion-exchange resins to reduce the amount of free fatty acids in the crude oil to 3% or less such that the resultant oil is useable in downstream chemical processes. After separation and removal of the free fatty acids form the crude oil, the ion-exchange resin is reusable in further free fatty acid separation reactions.

17 Claims, 14 Drawing Sheets a.

b.

c.

a.

b.

c.

a.

b.

C.

a.

b.

c.

d.

FREE FATTY ACID SEPARATION AND RECOVERY USING RESIN

RELATED APPLICATIONS

This application claims priority under 35 U.S.C. § 119(e) to U.S. Provisional Patent Application No. 63/194,571, filed May 28, 2021, which is incorporated herein by reference.

GOVERNMENT SUPPORT

This invention was made with government support under DE-SC0018420 awarded by the Department of Energy. The government has certain rights in the invention.

BACKGROUND OF THE INVENTION

There is considerable interest in substituting fossil fuels with sustainable biofuels for economic and environmental reasons. Much of the economically important transportation sector relies heavily on diesel. In addition, diesel fuel is important for allied sectors besides transportation. Biodiesel, which is manufactured from vegetable oil, is a commercial substitute. However, the production cost of biodiesel from vegetable oil is higher than fossil derived diesel and supply is constrained by availability of vegetable oil. As a substitute for vegetable oil, waste cooking oil can be used to produce biodiesel. Plants engineered for in situ oil accumulation in leaves and stems might be a future source as well.

Though waste cooking oil is relatively low cost compared to oil seeds and does not impinge on the edible oil market, it is often rich in free fatty acids (FFA). Furthermore, crops engineered for accumulation of triglycerides in green tissues (e.g., oilcane) also contain elevated levels of FFA. For biodiesel production, the oils are esterified with alcohol in presence of an alkali catalyst. However, FFA reacts with alkali to form soaps. This reduces the efficiency of the catalytic conversion and complicates downstream processing. Many approaches have been proposed to reduce the FFA content including steam distillation, ethanol-based extraction and esterification using acid catalysts and enzymes. The goal is reduced FFA content preferably below 1% because concentrations above 3% diminish the performance of the homogenous base catalyst used for biodiesel production. However, steam distillation operates at high temperature and has associated equipment cost, whereas ethanol extraction of fatty acids requires large amounts of solvent because of limited solubility.

Accordingly, there is a need for a simple, efficient method of separating the free fatty acids from the oil and permitting reuse of both the ion-exchange resin and the recovered free fatty acids. The present disclosure satisfies these needs.

SUMMARY OF THE INVENTION

The presence of free fatty acids interferes with conversion of plant oils to biodiesel. Four, strong and weak base ion-exchange resins were evaluated for free fatty acids (FFA) removal from oil. Amberlite FPA 51 brand ion-exchange resin showed the highest adsorption capacity of FFA. An ion-exchange resin concentration above 3% could enable a higher % FFA adsorption. The adsorption process fitted a pseudo-first-order kinetic model and achieved equilibrium in approximately 8 h. A full factorial design was used to optimize the ion-exchange resin and FFA concentrations at a fixed temperature (40° C.). A ratio of ion-exchange resin to fatty acid concentrations above 1.875 was sufficient for 70% adsorption and the amount adsorbed continued to increase with further added ion-exchange resin. A two-step washing of resin using hexane and ethanol recovered approximately 67.55±4.05% of the initially added fatty acid. The used ion-exchange resin was regenerated with 5% NaOH and re-used for a minimum of 3 consecutive cycles. However, the adsorption capacity diminished to 75% of the initial cycle in cycles 2 and 3. Thus, the work presents a resin-based process for deacidification of oil to reduce fatty acid content of oil for biodiesel production.

Accordingly, the disclosure provides for certain methods of separating and recovering free fatty acids from oil (also known as deacidifying the oil) such as crude oil, vegetable oil, and waste cooking oil. In one embodiment, the method comprises the steps of: a) contacting an ion-exchange resin with a first alcohol to activate the ion-exchange resin; b) drying the ion-exchange resin to provide an activated ion-exchange resin; c) mixing the activated ion-exchange resin with the crude oil to form a mixture, wherein the mixture comprises the crude oil and the ion-exchange resin, and the ratio of the activated ion-exchange resin and the FFA in the mixture is about 10:1 w/w to about 1.875:1 w/w; d) incubating the mixture to adsorb FFA from the crude oil onto the activated ion-exchange resin; e) filtering the mixture to form a treated oil and a separated ion-exchange resin comprising the adsorbed FAA and residual oil; f) washing the separated ion-exchange resin with a non-polar solvent to partition the residual oil from the separated ion-exchange resin to provide a washed ion-exchange resin and a first FFA fraction, wherein the first FFA fraction comprises the non-polar solvent, the residual oil, and desorbed FFA; and g) evaporating the non-polar solvent from the first FFA fraction to provide a second FFA fraction comprising the residual oil and the desorbed FFA; wherein a FFA content of less than 3% w/w remains in the treated oil.

In some embodiments, the method further comprises the steps of h) combining a second alcohol with the second FFA fraction to separate the desorbed FFA from the residual oil in the second FFA fraction; and i) removing the second alcohol from the residual oil in the second FFA fraction, wherein the second alcohol comprises the FFA, thereby recovering the FFA.

In some embodiments, the ion-exchange resin used in the methods comprises a styrene-divinylbenzene co-polymer that is weakly basic and comprises secondary amine functional groups, tertiary amine functional groups, or both secondary amine functional groups and tertiary amine functional groups.

In some embodiments, the ratio of the activated ion-exchange resin to the FFA in the mixture is about 5:1 w/w to about 1.875:1 w/w. In some embodiments, the mixture comprises about 0.5% w/w to about 15% w/w of activated ion-exchange resin.

After the FFA adsorb to the activated ion-exchange resin, the now treated oil comprises an FFA content of about 3% or less, or about 2% or less, or about 1% or less. The FFA adsorbed to the activated ion-exchange resin may be recovered and used in other downs stream chemical processes such as the production of biofuels and production of certain short and medium chain unsaturated fatty acids.

In one specific embodiment, a method of separating and recovering free fatty acids from vegetable oil or waste cooking oil comprises the steps of a) activating an ion-exchange resin with a first ethanol for about 1 hour to about 4 hours at about 25° C. to about 35° C. with agitation; b) drying the ion-exchange resin for about 2 hours to about 12 hours at about 45° C. to about 55° C. to provide an activated ion-exchange resin; c) mixing the activated ion-exchange resin with vegetable oil or waste cooking oil to form a mixture, wherein the mixture comprises the vegetable oil or the waste cooking oil and the activated ion-exchange resin, and the ratio of the activated ion-exchange resin and the FFA in the mixture is about 10:1 w/w to about 1.875:1 w/w; d) incubating the mixture for about 4 hours to about 8 hours at about 35° C. to about 45° C. to adsorb FFA from the vegetable oil or the waste cooking oil to the activated ion-exchange resin; e) filtering the mixture to form a treated oil and a separated ion-exchange resin comprising the adsorbed FAA and residual oil; f) washing the separated ion-exchange resin with hexane to partition the residual oil from the separated ion-exchange resin to provide a washed ion-exchange resin and a first FFA fraction, wherein the first FFA fraction comprises the hexane, the residual oil, and desorbed FFA; g) evaporating the hexane from the first FFA fraction to provide a second FFA fraction; h) combining a second ethanol fraction with the second FFA fraction to separate the desorbed FFA from the residual oil remaining in the second FFA fraction; i) removing the second ethanol from the second FFA fraction, wherein the second alcohol comprises the FFA; and j) evaporating the second ethanol fraction to recover the FFA; wherein a FFA content of less than 3% w/w remains in the treated oil.

The foregoing and other objects and features of the disclosure will become more apparent from the following detailed description, which proceeds with reference to the accompanying figures. Further embodiments, forms, features, aspects, benefits, objects, and advantages of the present application shall become apparent from the detailed description and figures provided herewith.

DETAILED DESCRIPTION OF THE INVENTION

Figure 1:
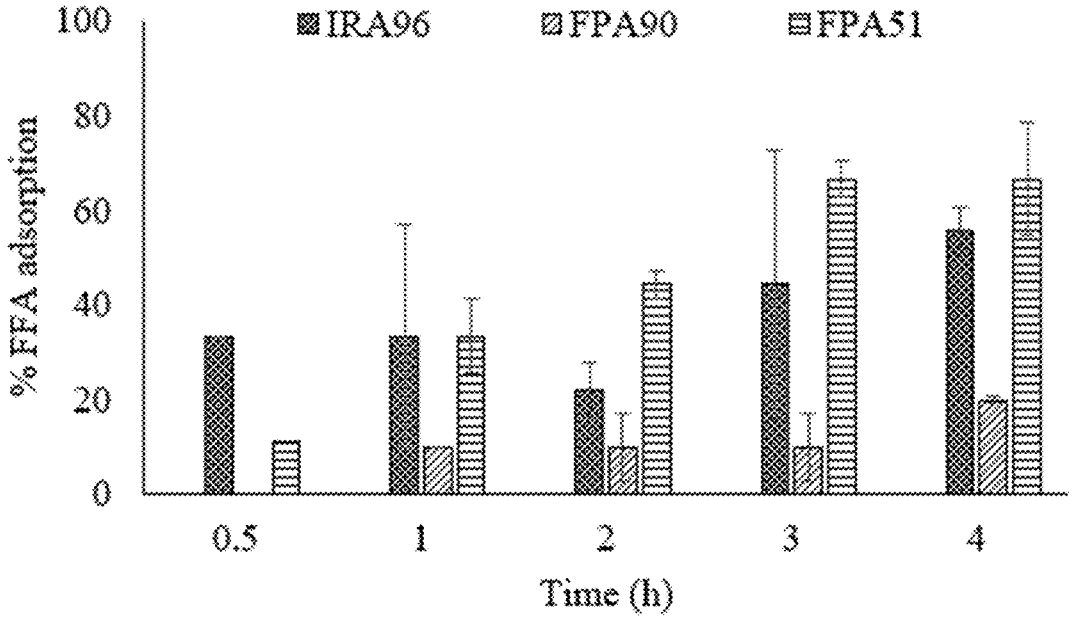
FIG. 1. Free fatty acid adsorption from refined soy oil using different resins: (a) palmitic acid, (b) stearic acid, and (c) oleic acid. Percentage FFA adsorption is expressed as average values±s.d.
Figure 1:
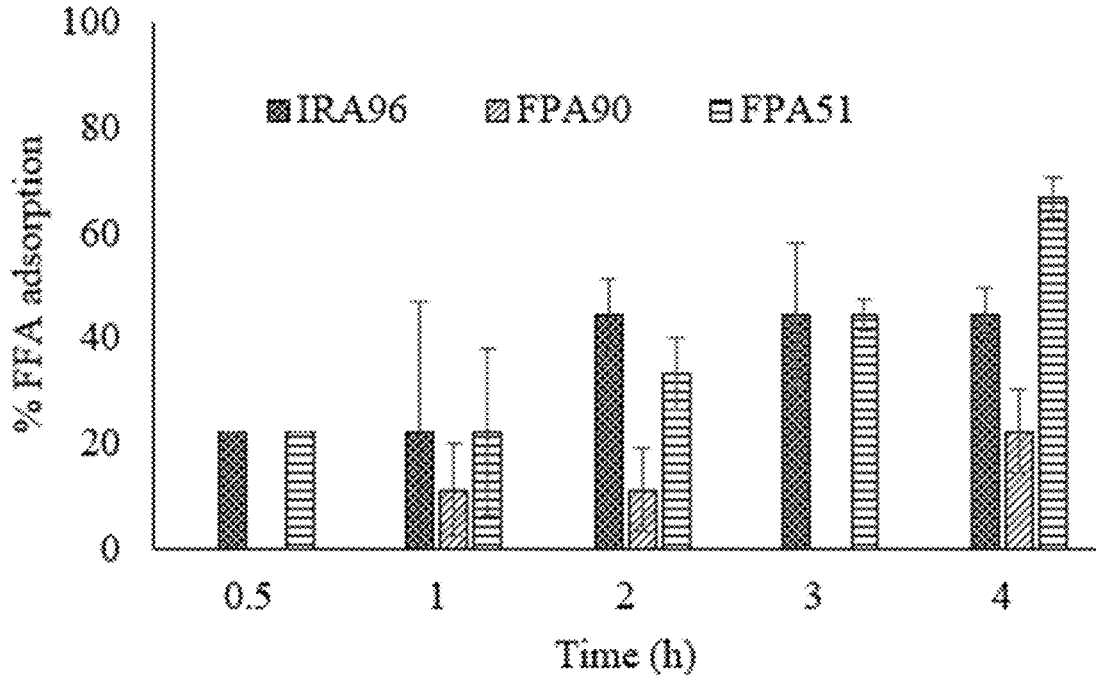
Figure 1:
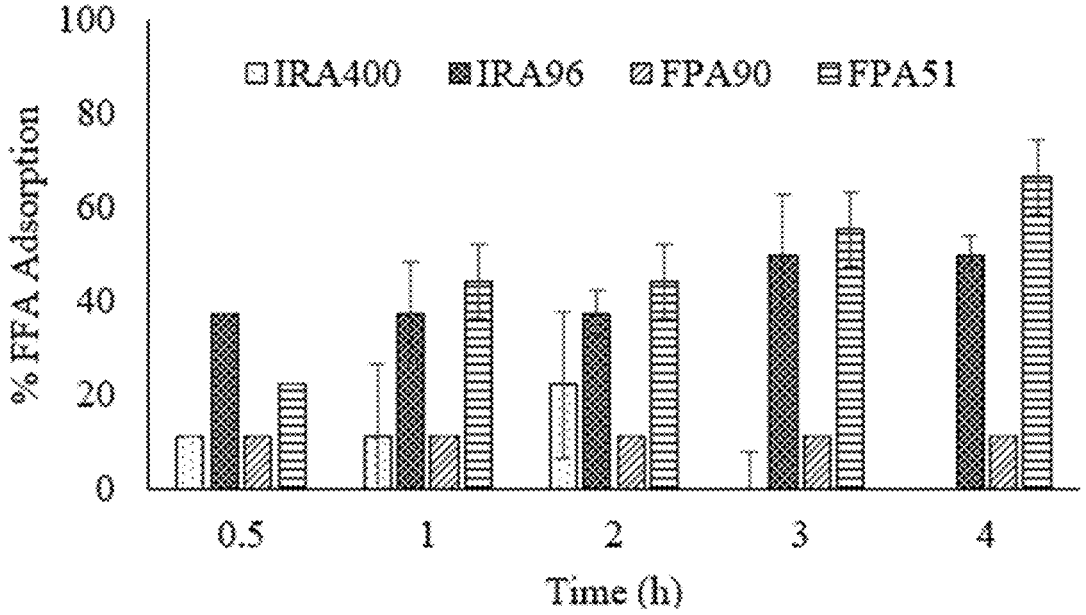

According to the present disclosure, a set of strong and weak ion-exchange resins were evaluated for removal of various free fatty acids (FFA) (e.g., palmitic acid, stearic acid and oleic acid) from refined soybean oil. Based on these results, adsorption of mixed FFA was optimized using a full factorial design. Further, a process for recovery of the adsorbed FFA and regenerating of the ion-exchange resin to allow for its reuse also is disclosed.

Definitions

The following definitions are included to provide a clear and consistent understanding of the specification and claims. As used herein, the recited terms have the following meanings. All other terms and phrases used in this specification have their ordinary meanings as one of skill in the art would understand. Such ordinary meanings may be obtained by reference to technical dictionaries, such as *Hawley's Condensed Chemical Dictionary* 14$^{th}$ Edition, by R. J. Lewis, John Wiley & Sons, New York, N.Y., 2001.

References in the specification to "one embodiment", "an embodiment", etc., indicate that the embodiment described may include a particular aspect, feature, structure, moiety, or characteristic, but not every embodiment necessarily includes that aspect, feature, structure, moiety, or characteristic. Moreover, such phrases may, but do not necessarily, refer to the same embodiment referred to in other portions of the specification. Further, when a particular aspect, feature, structure, moiety, or characteristic is described in connection with an embodiment, it is within the knowledge of one skilled in the art to affect or connect such aspect, feature, structure, moiety, or characteristic with other embodiments, whether or not explicitly described.

The singular forms "a," "an," and "the" include plural reference unless the context clearly dictates otherwise. Thus, for example, a reference to "a compound" includes a plurality of such compounds, so that a compound X includes a plurality of compounds X. It is further noted that the claims may be drafted to exclude any optional element. As such, this statement is intended to serve as antecedent basis for the use of exclusive terminology, such as "solely," "only," and the like, in connection with any element described herein, and/or the recitation of claim elements or use of "negative" limitations.

The term "and/or" means any one of the items, any combination of the items, or all of the items with which this term is associated. The phrases "one or more" and "at least one" are readily understood by one of skill in the art, particularly when read in context of its usage. For example, the phrase can mean one, two, three, four, five, six, ten, 100, or any upper limit approximately 10, 100, or 1000 times higher than a recited lower limit. For example, one or more substituents on a phenyl ring refers to one to five, or one to four, for example if the phenyl ring is disubstituted.

As will be understood by the skilled artisan, all numbers, including those expressing quantities of ingredients, properties such as molecular weight, reaction conditions, and so forth, are approximations and are understood as being optionally modified in all instances by the term "about." These values can vary depending upon the desired properties sought to be obtained by those skilled in the art utilizing the teachings of the descriptions herein. It is also understood that such values inherently contain variability necessarily resulting from the standard deviations found in their respective testing measurements. When values are expressed as approximations, by use of the antecedent "about," it will be understood that the particular value without the modifier "about" also forms a further aspect.

The terms "about" and "approximately" are used interchangeably. Both terms can refer to a variation of ±5%, ±10%, ±20%, or ±25% of the value specified. For example, "about 50" percent can in some embodiments carry a variation from 45 to 55 percent, or as otherwise defined by a particular claim. For integer ranges, the term "about" can include one or two integers greater than and/or less than a recited integer at each end of the range. Unless indicated otherwise herein, the terms "about" and "approximately" are intended to include values, e.g., weight percentages, proximate to the recited range that are equivalent in terms of the functionality of the individual ingredient, composition, or embodiment. The terms "about" and "approximately" can also modify the endpoints of a recited range as discussed above in this paragraph.

As will be understood by one skilled in the art, for any and all purposes, particularly in terms of providing a written description, all ranges recited herein also encompass any and all possible sub-ranges and combinations of sub-ranges thereof, as well as the individual values making up the range, particularly integer values. It is therefore understood that each unit between two particular units are also disclosed. For example, if 10 to 15 is disclosed, then 11, 12, 13, and 14 are also disclosed, individually, and as part of a range. A recited range (e.g., weight percentages or carbon groups) includes each specific value, integer, decimal, or identity within the range. Any listed range can be easily recognized as sufficiently describing and enabling the same range being broken down into at least equal halves, thirds, quarters, fifths, or tenths. As a non-limiting example, each range discussed herein can be readily broken down into a lower third, middle third and upper third, etc. As will also be understood by one skilled in the art, all language such as "up to", "at least", "greater than", "less than", "more than", "or more", and the like, include the number recited and such terms refer to ranges that can be subsequently broken down into sub-ranges as discussed above. In the same manner, all ratios recited herein also include all sub-ratios falling within the broader ratio. Accordingly, specific values recited for radicals, substituents, and ranges, are for illustration only; they do not exclude other defined values or other values within defined ranges for radicals and substituents. It will be further understood that the endpoints of each of the ranges are significant both in relation to the other endpoint, and independently of the other endpoint.

This disclosure provides ranges, limits, and deviations to variables such as volume, mass, percentages, ratios, etc. It is understood by an ordinary person skilled in the art that a range, such as "number1" to "number2", implies a continuous range of numbers that includes the whole numbers and fractional numbers. For example, 1 to 10 means 1, 2, 3, 4, 5, . . . 9, 10. It also means 1.0, 1.1, 1.2. 1.3, . . . , 9.8, 9.9, 10.0, and also means 1.01, 1.02, 1.03, and so on. If the variable disclosed is a number less than "number10", it implies a continuous range that includes whole numbers and fractional numbers less than number10, as discussed above. Similarly, if the variable disclosed is a number greater than "number10", it implies a continuous range that includes whole numbers and fractional numbers greater than number10. These ranges can be modified by the term "about", whose meaning has been described above.

One skilled in the art will also readily recognize that where members are grouped together in a common manner, such as in a Markush group, the invention encompasses not only the entire group listed as a whole, but each member of the group individually and all possible subgroups of the main group. Additionally, for all purposes, the invention encompasses not only the main group, but also the main group absent one or more of the group members. The invention therefore envisages the explicit exclusion of any one or more of members of a recited group. Accordingly, provisos may apply to any of the disclosed categories or embodiments whereby any one or more of the recited elements, species, or embodiments, may be excluded from such categories or embodiments, for example, for use in an explicit negative limitation.

The term "substantially" as used herein, is a broad term and is used in its ordinary sense, including, without limitation, being largely but not necessarily wholly that which is specified. For example, the term could refer to a numerical value that may not be 100% the full numerical value. The full numerical value may be less by about 1%, about 2%, about 3%, about 4%, about 5%, about 6%, about 7%, about 8%, about 9%, about 10%, about 15%, or about 20%.

Wherever the term "comprising" is used herein, options are contemplated wherein the terms "consisting of" or "consisting essentially of" are used instead. As used herein, "comprising" is synonymous with "including," "containing," or "characterized by," and is inclusive or open-ended and does not exclude additional, unrecited elements or method steps. As used herein, "consisting of" excludes any element, step, or ingredient not specified in the aspect element. As used herein, "consisting essentially of" does not exclude materials or steps that do not materially affect the basic and novel characteristics of the aspect. In each instance herein any of the terms "comprising", "consisting essentially of" and "consisting of" may be replaced with either of the other two terms. The disclosure illustratively described herein may be suitably practiced in the absence of any element or elements, limitation or limitations which is not specifically disclosed herein.

The formulas and compounds described herein can be modified using protecting groups. Suitable amino and carboxy protecting groups are known to those skilled in the art (see for example, Protecting Groups in Organic Synthesis, Second Edition, Greene, T. W., and Wutz, P. G. M., John Wiley & Sons, New York, and references cited therein; Philip J. Kocienski; Protecting Groups (Georg Thieme Verlag Stuttgart, New York, 1994), and references cited therein); and Comprehensive Organic Transformations, Larock, R. C., Second Edition, John Wiley & Sons, New York (1999), and referenced cited therein.

Many of the molecules disclosed herein contain one or more ionizable groups [groups from which a proton can be removed (e.g., —COOH) or added (e.g., amines) or which can be quaternized (e.g., amines)]. All possible ionic forms of such molecules and salts thereof are intended to be included individually in the disclosure herein. With regard to salts of the compounds herein, one of ordinary skill in the art can select from among a wide variety of available counterions those that are appropriate for preparation of salts of this disclosure for a given application. In specific applications, the selection of a given anion or cation for preparation of a salt may result in increased or decreased solubility of that salt.

Functional groups in anion exchange resins may include secondary amines, tertiary amines, and quaternary ammonium groups. As used herein, secondary amines comprise two organic substituents (alkyl, aryl, or both) bound to the nitrogen together with one hydrogen. As used herein, tertiary amines comprise three organic substituents. As used herein, quaternary amines, or quaternary ammonium, are positively charged polyatomic ions of the structure $NR_4^+$, R being an alkyl group or an aryl group.

As used herein, "crude oil" refers to an organic oil composition derived from plants or animals containing free fatty acids and one or more of triglycerides, diglycerides, monoglycerides, fatty acids, fatty acid esters, and alcohols (e.g., $C_2$-$C_{22}$ alkanols). Examples include vegetable oils such as plant seed extracts and plant fruit extracts, oil derived from vegetative tissue of plants, and oils from animal fat or fatty tissue, typically pressed or extracted unrefined and unprocessed oil. In one embodiment, the crude oil is a plant-derived oil. In another embodiment, the crude oil is an animal-derived oil. In other embodiments, the crude oil is a mixture of plant-derived oils and animal-derived oils.

As used herein, "vegetable oil" refers to oil extracted from the seeds and fruits of a plant.

As used herein, the term "vegetative tissues" refer to a plant part such as a leaf, a stem, a root, a shoot, a stalk, a leaf bud and excludes the seed and fruit portion of the plant.

As used herein, the term "cooking oil" refers to a vegetable oil or oil derived from vegetative tissue of plants used to cook food products.

As used herein, the term "waste cooking oils" refers to a cooking oil that has been used in a frying process of various food items.

AMBERLITE FPA-51 is the trade name for an ion-exchange resin having the following characteristics: a styrene-divinylbenzene copolymer macroporous matrix; weakly basic anion exchange resin wherein greater than 85% of the functional groups are secondary amines; the resin is formed of beige, opaque, spherical beads present in the free base form; a particle diameter of 490 μm-590 μm; a total exchange capacity of greater than or equal to 1.30 equivalent/Liter (eq/L); a swelling capacity of 25%, and a water retention capacity of 56% to 62%.

AMBERLITE IRA-400 (CL) is the trade name for an ion-exchange resin having the following characteristics: a styrene-divinylbenzene copolymer gel matrix; strongly basic anion exchange resin comprising dimethyl-ethanolammonium amine functional groups; the resin is pale yellow in color, translucent, spherical beads an present in the chloride ionic form; a particle diameter of 600 μm-750 μm; a uniformity coefficient go equal to or greater than 1.60; a total exchange capacity of greater than or equal to 1.25 eq/L; a swelling capacity of 20%, and a water retention capacity of 45% to 51%.

AMBERLITE IRA-96 is the trade name an ion-exchange resin having the following characteristics: a styrene-divinylbenzene copolymer macroporous matrix; weakly basic anion exchange resin comprising tertiary amine functional groups; the resin is formed of white to tan, opaque, spherical beads present in the free base form; a particle diameter of 550 μm-750 μm; a total exchange capacity of greater than or equal to 1.30 eq/L; a swelling capacity of 15%, and a water retention capacity of 59% to 65%.

AMBERLITE FPA-90 (CL) is the trade name for an ion-exchange resin having the following characteristics: a styrene-divinylbenzene copolymer macroporous matrix; strongly basic anion exchange resin comprising quaternary ammonium functional groups; the resin is off-white in color, opaque, spherical beads present in the chloride ionic form; a particle diameter of 65 μm-820 μm; a total exchange capacity of greater than or equal to 1.0 eq/L; a swelling capacity of 25%, and a water retention capacity of 58% to 64%.

As used herein, "treated oil" refers to an oil (e.g., crude oil, vegetable oil, or waste cooking oil) in which the oil has been treated according to the methods described herein and the free fatty acid content of the oil after said treatment is 3% w/w or less of the oil.

As used herein, the term "refreshed ion-exchange resin" refers to an ion-exchange resin that has been washed with a solution (e.g., aqueous sodium hydroxide solution) to reactive the functional groups of the matrix of the resin.

Embodiments of the Invention

The disclosure provides for methods of separating and removing (i.e., deacidifying) free fatty acids (FFA) from the oil through the use of reusable ion-exchange resins. After removal of the FFA from the oil, the resultant oil may be used in the production of biofuels such as biodiesel or reused as cooking oil and the separated and recovered FFA may be reused in other chemical processes.

One embodiment of a method for separating and recovering free fatty acids (FFA) from oil (e.g., crude oil) containing FFA comprising: a) contacting an ion-exchange resin with a first alcohol to activate the ion-exchange resin; b) drying the ion-exchange resin to provide an activated ion-exchange resin; c) mixing the activated ion-exchange resin with the crude oil to form a mixture, wherein the mixture comprises the crude oil and the ion-exchange resin, and the ratio of the activated ion-exchange resin and the FFA in the mixture is about 10:1 w/w to about 1.875:1 w/w; d) incubating the mixture to adsorb FFA from the crude oil onto the activated ion-exchange resin; e) filtering the mixture to form a treated oil and a separated ion-exchange resin comprising the adsorbed FAA and residual oil; f) washing the separated ion-exchange resin with a non-polar solvent to partition the residual oil from the separated ion-exchange resin to provide a washed ion-exchange resin and a first FFA fraction, wherein the first FFA fraction comprises the non-polar solvent, the residual oil, and desorbed FFA; and g) evaporating the non-polar solvent from the first FFA fraction to provide a second FFA fraction comprising the residual oil and the desorbed FFA; wherein a FFA content of less than 3% w/w remains in the treated oil.

In some embodiments, the method further comprises the steps of h) combining a second alcohol with the second FFA fraction to separate the desorbed FFA from the residual oil in the second FFA fraction; and i) removing the second alcohol from the residual oil in the second FFA fraction, wherein the second alcohol comprises the FFA, thereby recovering the FFA.

In some embodiments, the method further comprises the step of rinsing the washed ion-exchange resin with aqueous sodium hydroxide to reactivate the functional groups of the separated ion-exchange resin. In some embodiments, the step of washing the separated ion-exchange resin with aqueous sodium hydroxide to reactivate the functional groups of the separated ion-exchange resin is performed after the step of removing the second alcohol from the second FFA fraction.

In some embodiments, steps of the method are performed sequentially (e.g., a-i)).

Compositions known as "ion-exchange resins", "exchange resins", or "resins", for use in the present invention are solid, non-soluble polymeric materials capable of interacting and attaching to various elements and allows for capturing of the elements from a mixture. Ion-exchange resins are generally composed of inert compounds including, but not limited to, sephadex, polystyrene, polyacrylamide, polymethacrylate or neutral polysaccharides. They may also include cross-linked natural polymers like cellulose, dextran or agarose.

Ion-exchange resins for use with embodiments of the invention preferably comprise polymeric anion-exchange resin and/or cation-exchange resin. Ion-exchange resin may comprise a solid support containing insoluble carrier of an electrical charge polymers carrying fixed functional groups or sites with exchangeable ions. Illustrative examples of suitable ion-exchange resins for preparing microparticles include anion exchange resins, cation exchange resins, and mixed-mode chromatography resins, also sometimes referred to as mixed-mode ion exchange resins. The exchangeable ion form is generally one or more of $Na^+$, $H^+$, $OH^-$, or $Cl^-$ ions, depending on the type of ion exchangeable resin. Ion exchange resin includes weak and strong acid cation exchange resins as well as weak and strong base anion exchange resins. Suitable ion exchange resins further include chelating resins.

The anion-exchange resins used herein can be weakly or strongly basic. As used herein, the term "weakly basic anion exchange resin" refers to a resin having an apparent dissociation constant or ionization constant (pKa) greater than about 8.5 as measured by conventional methods (for example, Fisher et al., "Effect of Cross-linking on the Properties of Carboxylic Polymers. I. Apparent Dissociation Constants of Acrylic and Methacrylic Acid Polymers" J. Phys. Chem., 60(8), 1030 (1956)). Weakly basic ion-exchange resin may have the primary, secondary, and/or ternary amino groups, e.g., polyethylene amine as the exchange group. The term "strongly basic anion exchange resin," on the other hand, refers to an ion-exchange resin having a pKa less than about 12. A strongly basic anion exchange resin may have quaternary amino groups, for example, trimethylammonium groups, e.g., polyAPTAC, or dimethylethanolamine as the exchange group. Thus, in some embodiments, the functional groups of the ion-exchange resin comprise one or more of quaternary amine functional groups, tertiary amine functional groups, secondary amine functional groups, or a combination thereof. In some embodiments, the functional groups of the ion-exchange resin comprise secondary and tertiary amine groups.

Various ion-exchange resins that may be used with the embodiments described herein comprise a polysulfonated material such as, for example, a sulfonated styrene co-divinyl benzene (crosslinked) ion exchange resin, a polymethacrylic acid, co-divinylbenzene (crosslinked) ion exchange material that are completely insoluble in water by virtue of the divinylbenzene crosslinking of the polymers. The crosslinking monomer, generally divinylbenzene, may be present in the final matrix from 0.1 to 55 mole %. Commercial ion exchange materials can possess on the order of 40 to 55% of divinylbenzene isomers. Generally, the percentage of crosslinking agent is presented as mol % however it may also be presented as wt % and the amount of swelling (water absorption) and the ion exchange capacity are proportional to the amount of cross linking. For greater amounts of cross linking, ion exchange capacity and water absorption may decrease for a consistent chemistry such as divinylbenzene cross linked polystyrene sulfonate.

Other anion ion-exchange resins that may be used with the embodiments of the invention described herein include hydroxyethyl methacrylate (HEMA)-based, dimethylamino ethylmethacrylate (DMAEMA)-based, dimethylamino ethylmethacrylate (pDMAEMA) based, polyacrylamide based, or methacrylic acid (MAA) based.

In some embodiments, the ion-exchange resin comprises a strongly basic styrene-divinylbenzene copolymer or a weakly basic styrene-divinylbenzene copolymer. More preferably, the ion-exchange resin is polystyrene cross-linked with divinylbenzene (DVB), and is a weakly basic exchange resin comprising secondary or tertiary amine functional groups.

In some embodiments, the ion-exchange resin comprises a gel matrix or a macroporous matrix.

In some embodiments, the ion-exchange resin comprises a total exchange capacity of greater that about 1.0 eq/L, greater than about 1.1 eq/L, greater than about 1.2 eq/L, greater than about 1.3 eq/L, greater than about 1.4 eq/L, or greater than about 1.5 eq/L.

In some embodiments, the ion-exchange resin comprises spheres or spheroids having a particle diameter of about 50 μm to about 1000 μm, about 60 to about 900 μm, about 70 μm to about 850 μm, or about 80 μm to about 800 μm, In some embodiments, spheres or spheroids have a diameter of about or about 50 μm to about 1000 μm, about or about 100 μm to about 950 μm, or about 150 μm to about 900 μm, about 200 μm to about 850 μm, about 250 μm to about 800 μm, about 300 μm to about 750 μm, about 350 μm to about 750 μm, about 400 μm to about 700 μm, about 450 μm to about 650 μm, or about 500 μm to about 600 μm.

In some embodiments, the ion-exchange resins have a uniformity coefficient of greater than about 1.1, greater than about 1.2, greater than about 1.3, greater than about 1.4, greater than about 1.5, greater than about 1.6, greater than about 1.7, greater than about 1.8, greater than about 1.9, or greater than about 2.

In some embodiments, suitable ion-exchange resins comprise a swelling percentage of about 10%, about 15%, about 20%, about 25%, or about 30% and a water retention capacity of about 40% to about 70%, about 45% to about 65%, about 50% to about 60%; or about 40% to about 65%, about 45% to about 65%, about 50% to about 65%, about 55% to about 65%, or about 60% to about 65%.

In some embodiments, the ion-exchange resin is one or more of Amberlite IRA-400 (Cl) brand ion-exchange resin, Amberlite FPA-90 (Cl) brand ion-exchange resin, Amberlite IRA-96 brand ion-exchange resin, and Amberlite FPA-51 brand ion-exchange resin. In one embodiment, the ion-exchange resin is Amberlite FPA-51 brand ion-exchange resin.

In some embodiments, the ion-exchange resin is contacted with a first alcohol fraction in order to activate the exchange resin. Preferably the first alcohol fraction is methanol, ethanol, propanol, isopropyl alcohol, butanol, or a combination thereof.

In some embodiments, the activated ion-exchange resin is mixed with the oil to form an oil mixture. The crude oil mixture comprises the activated ion-exchange resin and the FFA in a ratio of about 15:1 w/w to about 1.5:1 w/w, about 14:1 w/w to about 1.6:1 w/w; about 13:1 w/w to about 1.7:1 w/w; about 12:1 w/w to about 1.8:1 w/w; about 11:1 w/w to about 1.9:1 w/w, or about 10:1 w/w to about 2:1 w/w. In some embodiments, the ratio of the activated ion-exchange resin to FFA is about 10:1 w/w to about 1.875:1 w/w, or about 5:1 w/w to about 1.875:1 w/w.

In some embodiments, the oil mixture (oil+activated ion-exchange resin) comprises the activated ion-exchange resin in an amount of about 0.5% w/w to about 15% w/w of the oil mixture, about 1% w/w to about 15% w/w of the oil mixture, about 1.5% w/w to about 15% w/w of the oil mixture, about 2% w/w to about 15% w/w of the oil mixture, about 2.5% w/w to about 15% w/w of the oil mixture, about 3% w/w to about 15% w/w of the oil mixture, about 3.5% w/w to about 15% w/w of the oil mixture, or about 4% w/w to about 15% w/w of the oil mixture. In other embodiments, the oil mixture (oil+activated ion-exchange resin) comprises activated ion-exchange resin in an amount of about 0.5% w/w to about 10% w/w of the oil mixture, about 1% w/w to about 9.5% w/w of the oil mixture, about 1.5% w/w to about 9% w/w of the oil mixture, about 2% w/w to about 8.5% w/w of the oil mixture, about 2.5% w/w to about 8% w/w of the oil mixture, about 3% w/w to about 7.5% w/w of the oil mixture, about 3.5% w/w to about 7% w/w of the oil mixture, or about 4% w/w to about 6.5% w/w of the oil mixture. In one embodiment, the oil mixture comprises the activated ion-exchange resin in an amount of about 2% w/w to about 7.5% w/w.

In some embodiments, the mixture of oil and activated ion-exchange resin is incubated for a certain time period in order to adsorb the FFA in the oil onto the activated ion-exchange resin. The incubation period may be from 1 hour to about 24 hours, about 2 hours to about 22 hours, about 3 hours to about 20 hours, about 4 hours to about 18 hours, about 5 hours to about 16 hours, about 6 hours to about 14 hours, about 7 hours to about 14 hours, or about 8 hours to about 12 hours. In other embodiments, the incubation period may be about 2 hour to about 12 hours, about 4 hours to about 10 hours, or about 4 hours to about 8 hours.

After the incubation period, the mixture may be filtered to separate the activated ion-exchange resin from the oil to provide a treated oil fraction comprising a FFA content of less than 3% w/w and a separated ion-exchange resin (i.e., the oil is considered "treated" after using the oil in a separation reaction as described herein). In some embodiments, the treated oil comprises about 3% w/w or less of FFA content, about 2.5% w/w or less of FFA content, about 2% w/w or less of FFA content, about 1.5% w/w or less of FFA content, or about 1% w/w or less of FFA content.

In some embodiments, the separated ion-exchange resin is washed with a non-polar solvent to partition the residual oil from the separated ion-exchange resin to provide a washed ion-exchange resin and a first FFA fraction, wherein the first FFA fraction comprises the non-polar solvent, the residual oil, and desorbed FFA.

In some embodiments, the non-polar solvent is pentane, hexane, heptane, cyclopentane, cyclohexane, cycloheptane, benzene, toluene, xylene, chloroform, diethyl ether, ethyl acetate, carbon tetrachloride, 1,4 dioxane, dichloromethane, or pyridine.

In one embodiment, the separated ion-exchange resin is washed with hexane to partition any residual oil from the separated ion-exchange resin (to provide a first FFA fraction comprises the non-polar solvent, the residual oil, and the desorbed FFA) after separation of the activated ion-exchange resin from the treated oil fraction.

In some embodiments, the non-polar solvent is evaporated from the first FFA fraction to produce a second FFA fraction comprising the residual oil and the desorbed FFA. The second FFA fraction is then contacted with or mixed with a second alcohol to separate the desorbed FFA from residual oil remaining in the second FFA fraction. The second alcohol is the same alcohol or a different alcohol than the first alcohol. Preferably the second alcohol is methanol, ethanol, propanol, isopropyl alcohol, butanol, or a combination thereof. In some embodiments, the first alcohol and the second alcohol are ethanol.

In some embodiments, the second alcohol is removed and collected from the remaining residual oil, wherein the second alcohol fraction comprises the FFA, thereby separating and recovering the FFA. The remaining residual oil may be added back to the treated oil, thus preventing loss of oil through the separation process.

In some embodiments, the oil used in the methods of separation described herein is a crude oil. In some embodiments, the crude oil is a vegetable oil, a waste cooking oil, or an oil derived from vegetative tissue.

In some embodiments, the oil used in embodiments of the invention comprise one or more vegetable oils or cooking oils such as, but not limited to, palm oil, soybean oil, rapeseed oil, peanut oil, cottonseed oil, palm kernel oil, coconut oil, olive oil, and combinations thereof. Other exemplary vegetable oils include corn oil, grape seed oil, hazelnut oil, linseed oil, rice bran oil, safflower oil, sesame oil, açaí palm oil, jambú oil, graviola oil, tucumã oil, brazil nut oil, carapa oil, buriti oil, passion fruit oil, pracaxi oil, sunflower oil, *sorghum* oil, solarium oil, and walnut oil. Generally, vegetable oils are oils extracted from the seeds of a given plant.

In some embodiments, suitable oils for use with embodiment of the invention include oils from vegetative tissue (e.g., leaves, stems, fruits of a plant but excluding the seeds) from plants including, but are not limited to, corn (*Zea mays*), *Brassica* sp. (e.g., *B. napus, B. rapa, B. juncea*), alfalfa (*Medicago sativa*), rice (*Oryza sativa*), rye (*Secale cereale*), *sorghum* (*Sorghum bicolor, Sorghum vulgare*), millet (e.g., pearl millet (*Pennisetum glaucum*), proso millet (*Panicum miliaceum*), foxtail millet (*Setaria italica*), finger millet (*Eleusine coracana*)), sunflower (*Helianthus annuus*), safflower (*Carthamus tinctorius*), wheat (*Triticum aestivum*), soybean (*Glycine max*), tobacco (*Nicotiana tabacum*), potato (*Solanum tuberosum*), peanuts (*Arachis hypogaea*), cotton (*Gossypium barbadense, Gossypium hirsutum*), sweet potato (*Ipomoea batatus*), cassava (*Manihot esculenta*), coffee (*Coffea* spp.), coconut (*Cocos nucifera*), pineapple (*Ananas comosus*), *Citrus* trees (*Citrus* spp.), cocoa (*Theobroma cacao*), tea (*Camellia sinensis*), banana (*Musa* spp.), avocado (*Persea americana*), fig (*Ficus casica*), guava (*Psidium guajava*), mango (*Mangifera indica*), olive (*Olea europaea*), *papaya* (*Carica papaya*), cashew (*Anacardium occidentale*), *Macadamia* (*Macadamia integrifolia*), almond (*Prunus amygdalus*), sugar beets (*Beta vulgaris*), sugarcane (*Saccharum* spp.), oats, and barley.

Oil from vegetative tissue of plants important or interesting for agriculture, horticulture, biomass production (for production of liquid fuel molecules and other chemicals), and/or forestry may be used in the methods of the disclosure. Non-limiting examples include, for instance, *Panicum virgatum* (switchgrass), *Miscanthus giganteus* (*miscanthus*), *Saccharum* spp. (sugarcane, energycane), *Populus balsamifera* (poplar), cotton (*Gossypium barbadense, Gossypium hirsutum*), *Helianthus annuus* (sunflower), *Medicago sativa* (alfalfa), *Beta vulgaris* (sugarbeet), *sorghum* (*Sorghum bicolor, Sorghum vulgare*), *Erianthus* spp., *Andropogon gerardii* (big bluestem), *Pennisetum purpureum* (elephant grass), *Phalaris arundinacea* (reed canarygrass), *Cynodon dactylon* (bermudagrass), *Festuca arundinacea* (tall fescue), *Spartina pectinata* (prairie cord-grass), *Arundo donax* (giant reed), *Secale cereale* (rye), Salix spp. (willow), *Eucalyptus* spp. (*eucalyptus*, including *E. grandis* (and its hybrids, known as "urograndis"), *E. globulus, E. camaldulensis, E. tereticornis, E. viminalis, E. nitens, E. saligna* and *E. urophylla*), *Triticosecale* spp. (*triticum*-wheatxrye), teff (*Eragrostis tef*), Bamboo, *Carthamus tinctorius* (safflower), *Jatropha curcas* (jatropha), *Ricinus communis* (castor), *Elaeis guineensis* (palm), *Linum usitatissimum* (flax), *Manihot esculenta* (cassava), *Lycopersicon esculentum* (tomato), *Lactuca sativa* (lettuce), *Phaseolus vulgaris* (green beans), *Phaseolus limensis* (lima beans), *Lathyrus* spp. (peas), *Musa paradisiaca* (banana), *Solanum tuberosum* (potato), *Brassica* spp. (*B. napus* (canola), *B. rapa, B. juncea*), *Brassica oleracea* (broccoli, cauliflower, brussel sprouts), *Camellia sinensis* (tea), *Fragaria ananassa* (strawberry), *Theobroma cacao* (cocoa), *Coffea arabica* (coffee), *Vitis vinifera* (grape), *Ananas comosus* (pineapple), *Capsicum annum* (hot & sweet pepper), *Arachis hypogaea* (peanuts), *Ipomoea batatus* (sweet potato), *Cocos nucifera* (coconut), *Citrus* spp. (*Citrus* trees), *Persea americana* (avocado), fig (*Ficus casica*), guava (*Psidium guajava*), mango (*Mangifera indica*), olive (*Olea europaea*), *Carica papaya* (*papaya*), *Anacardium occidentale* (cashew), *Macadamia integrifolia* (*macadamia* tree), *Prunus amygdalus* (almond), *Allium cepa* (onion), *Cucumis melo* (musk melon), *Cucumis sativus* (cucumber), *Cucumis cantalupensis* (cantaloupe), *Cucurbita maxima* (squash), *Cucurbita moschata* (squash), *Spinacea oleracea* (spinach), *Citrullus lanatus* (watermelon), *Abelmoschus esculentus* (okra), *Solanum melongena* (eggplant), *Cyamopsis tetragonoloba* (guar bean), *Ceratonia siliqua* (locust bean), *Trigonella foenum-graecum* (fenugreek), *Vigna radiata* (mung bean), *Vigna unguiculata* (cowpea), *Vicia faba* (fava bean), *Cicer arietinum* (chickpea), *Lens culinaris* (lentil), *Papaver somniferum* (opium poppy), *Papaver orientale, Taxus baccata, Taxus brevifolia, Artemisia annua, Cannabis sativa, Camptotheca acuminate, Catharanthus roseus, Vinca rosea, Cinchona officinalis, Colchicum autumnale, Veratrum californica, Digitalis lanata, Digitalis purpurea, Dioscorea* spp., *Andrographis paniculata, Atropa belladonna, Datura stomonium, Berberis* spp., *Cephalotaxus* spp., *Ephedra sinica, Ephedra* spp., *Erythroxylum coca, Galanthus wornorii, Scopolia* spp., *Lycopodium serratum* (*Huperzia serrata*), *Lycopodium* spp., *Rauwolfia serpentina, Rauwolfia* spp., *Sanguinaria canadensis, Hyoscyamus* spp., *Calendula officinalis, Chrysanthemum parthenium, Coleus forskohlii, Tanacetum parthenium, Parthenium argentatum* (guayule), *Hevea* spp. (rubber), *Mentha spicata* (mint), *Mentha piperita* (mint), *Bixa orellana* (achiote), *Alstroemeria* spp., *Rosa* spp. (rose), *Rhododendron* spp. (azalea), *Macrophylla hydrangea* (*hydrangea*), *Hibiscus rosasanensis* (*Hibiscus*), *Tulipa* spp. (tulips), *Narcissus* spp. (daffodils), *Petunia hybrida* (petunias), *Dianthus caryophyllus* (carnation), *Euphorbia pulcherrima* (poinsettia), *chrysanthemum, Nicotiana tabacum* (tobacco), *Lupinus albus* (lupin), *Uniola paniculata* (oats), bentgrass (*Agrostis* spp.), *Populus tremuloides* (aspen), *Pinus* spp. (pine), *Abies* spp. (fir), *Acer* spp. (maple), *Hordeum vulgare* (barley), *Poa pratensis* (bluegrass), *Lolium* spp. (ryegrass), *Phleum pratense* (timothy), and conifers.

In some embodiments, the oil used in embodiments of the invention comprise oil extracted from bioengineered plants species (e.g., oils having altered fatty acid compositions via Genetically Modified Organisms (GMO) such as, but not limited to, tobacco (*Nicotiana* Sp.), Cruciferous vegetables (*Brassica* Sp.), *Arabidopsis thaliana*, and sugar cane (*Saccharum* Sp.). In various embodiments, the source of oil may be animal fats and greases (e.g., tallow, lard, butter fat, and chicken fat), and fish oils (candlefish oil, cod-liver oil, orange roughy oil, sardine oil, herring oil, and menhaden oil).

In one embodiment of the invention, a method for separating and recovering free fatty acids (FFA) from vegetable oil or waste cooking oil containing FFA comprises the steps of: of a) activating an ion-exchange resin with a first ethanol for about 1 hour to about 4 hours at about 25° C. to about 35° C. with agitation; b) drying the ion-exchange resin for about 2 hours to about 12 hours at about 45° C. to about 55° C. to provide an activated ion-exchange resin; c) mixing the activated ion-exchange resin with vegetable oil or waste cooking oil to form a mixture, wherein the mixture comprises the vegetable oil or the waste cooking oil and the activated ion-exchange resin, and the ratio of the activated ion-exchange resin and the FFA in the mixture is about 10:1 w/w to about 1.875:1 w/w; d) incubating the mixture for about 4 hours to about 8 hours at about 35° C. to about 45° C. to adsorb FFA from the vegetable oil or the waste cooking oil to the activated ion-exchange resin; e) filtering the mixture to form a treated oil and a separated ion-exchange resin comprising the adsorbed FAA and residual oil; f) washing the separated ion-exchange resin with hexane to partition the residual oil from the separated ion-exchange resin to provide a washed ion-exchange resin and a first FFA fraction, wherein the first FFA fraction comprises the hexane, the residual oil, and desorbed FFA; g) evaporating the hexane from the first FFA fraction to provide a second FFA fraction; h) combining a second ethanol with the second FFA fraction to separate the desorbed FFA from the residual oil in the second FFA fraction; i) removing the second ethanol from the second FFA fraction, wherein the second alcohol comprises the FFA; and j) evaporating the second ethanol fraction to recover the FFA; wherein a free fatty acid content of less than 3% w/w remains in the treated oil.

In some embodiments, ion-exchange resin is washed with a first ethanol fraction for about 1 hour to about 8 hours, about 2 hours to about 6 hours, or about 2 hours to about 4 hours, at about 25° C. to about 35° C., or about 30° C., and preferably with agitation.

After washing with the first alcohol, the now activated ion-exchange resin may be dried for about 1 hours to about 24 hours, about 2 hours to about 12 hours, about 3 hours to about 8 hours, or about 4 hours to about 6 hours, preferably the drying is at a temperature of about 45° C. to about 55° C., or about 40° C.

In some embodiments, the activated ion-exchange resin is mixed with the vegetable oil or the waste cooking oil to form an oil mixture wherein the FFA in the oil mixture adsorb to the activated ion-exchange resin for an incubation period of about 2 hours to about 10 hours, about 2 hours to about 8 hours, about 2 hours to about 6 hours, or about 2 hours to about 4 hours. Preferably, the incubation period is at about 35° C. to about 45° C., or about 40° C.

In some embodiments, the washed ion-exchange resin may be rinsed with an aqueous sodium hydroxide solution for about 20 minutes to about 90 minutes at about 25° C. to about 35° C. with agitation to reactivate functional groups of the washed ion-exchange resin.

In some embodiments, the ion-exchange resin is usable in a subsequent separation reaction after rinsing with the aqueous sodium hydroxide solution. Preferably, the aqueous sodium hydroxide solution comprises about 2% w/v to about 8% w/v sodium hydroxide, or more preferably, about 3% w/v to about 6% w/v sodium hydroxide, or more preferably, about 4% w/v to about 5% w/v sodium hydroxide.

Preferably, the separated and recovered FFA from the crude oil may be used in certain downstream chemical processes such as the formation of small or medium chain unsaturated fatty acids or for use in the production of biodiesel or biofuel. The recovered FFA may include palmitic acid, eicosanoic acid, stearic acid, arachidonic acid, oleic acid, eladic acid, lauric acid, and linoleic acid.

Results and Discussion

Ion-exchange resin with basic functional groups provides lone pair of electrons for weak interaction with the acidic carboxylic groups of FFA. The weak interactions adsorb FFA onto the resins. The adsorption kinetics of stearic acid dissolved in isooctane was studied using bentonite as the adsorbent. Adsorption fitted a Langmuir and Freundlich type isotherm, and the sorption capacity was dependent on temperature. Similarly, anion exchange resin such as Amberlyst 26A OH is as an efficient adsorbent for removing oleic acid from ethanol. Amberlyst 26A OH have also been reported for deacidification of degummed soybean oil dissolved in isopropanol, while also removing undesirable components including phospholipids and peroxides. However, using an organic solvent to solubilize FFA/vegetable oil may not reflect the behavior of FFA present in natural oil or waste cooking oil. Thus, adsorption kinetics of stearic acid and oleic acid dissolved in refined soybean oil was determined using various strong and weak base resins. The authors report that the adsorption of FFA on basic resins follow a Freundlich type isotherm, where the adsorption process is spontaneous and exothermic in nature. However, in the study, fatty acids were dissolved individually in the refined soybean oil, which may not be representative of the complexity obtained when different FFA are present in unrefined vegetable oil. Moreover, the available literature does not consider recovery of the adsorbed FFA for further uses. Also, these studies did not consider regeneration of the resin.

To identify a resin having a suitably high adsorption capacity for removing FFA from refined oil, various ion-exchange resins (5% w/w of oil) were mixed with FFA solutions (2% w/w of oil). As shown in FIG. 1, weak base ion-exchange resins were more effective than strong base ion-exchange resins in adsorbing FFA. Amberlite FPA-51, which possesses a secondary amine functional group, adsorbed the highest percentage of FFA; irrespective of the FFA, it removed 65% within 4 h. The adsorption of fatty acids on ion-exchange resin can be explained by Lewis acid base interaction and depends on the number of electron donors and their ease of accessibility. It has been proposed that styrene-divinylbenzene matrix containing secondary and tertiary amine as active group have more electron donors as compared to ion-exchange resin possessing quaternary amine. Also, the lone pair of electrons of secondary amine and tertiary amines are more accessible as compared to quaternary amines. This would explain the higher adsorption capacity of weak base Amberlite FPA-51 compared to the others as observed in this study. Also, the weak base resins are supplied as their free base form as compared to chloride form of strong ion-exchange base resin. As the ion-exchange resins were used without chemical modification to minimize the use of solvent, the charged form of strong base resin may have limited the adsorption of FFA.

Figure 2:
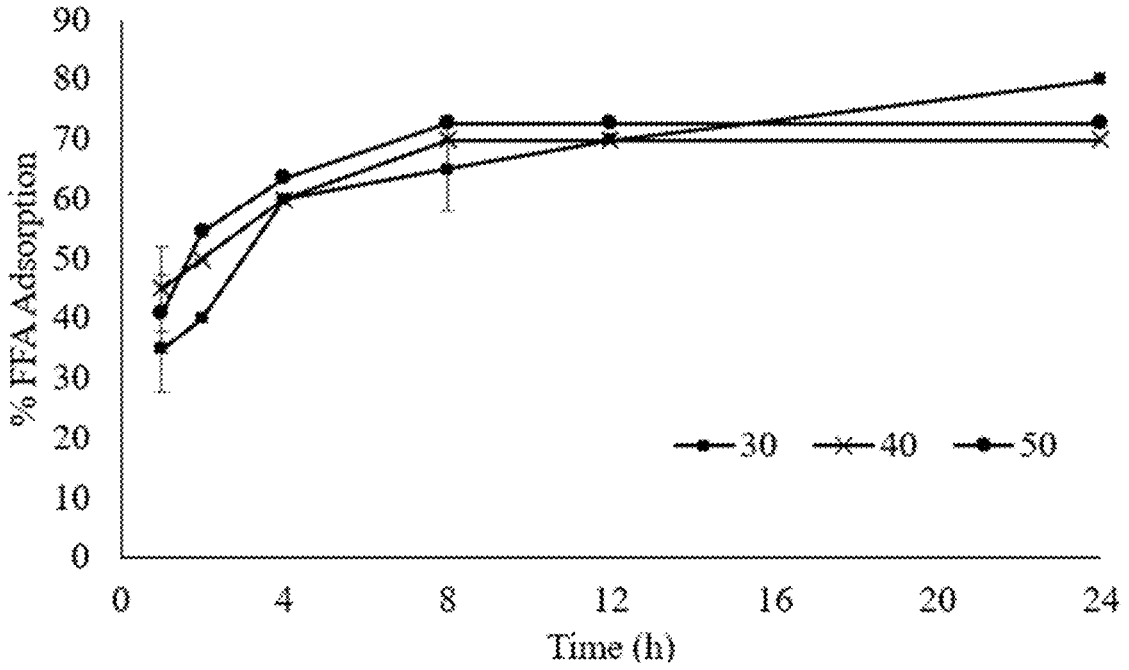
FIG. 2. Effect of temperature on FFA adsorption (a) palmitic acid, (b) stearic acid, and (c) oleic acid. Percentage FFA adsorption is expressed as average values±s.d.
Figure 2:
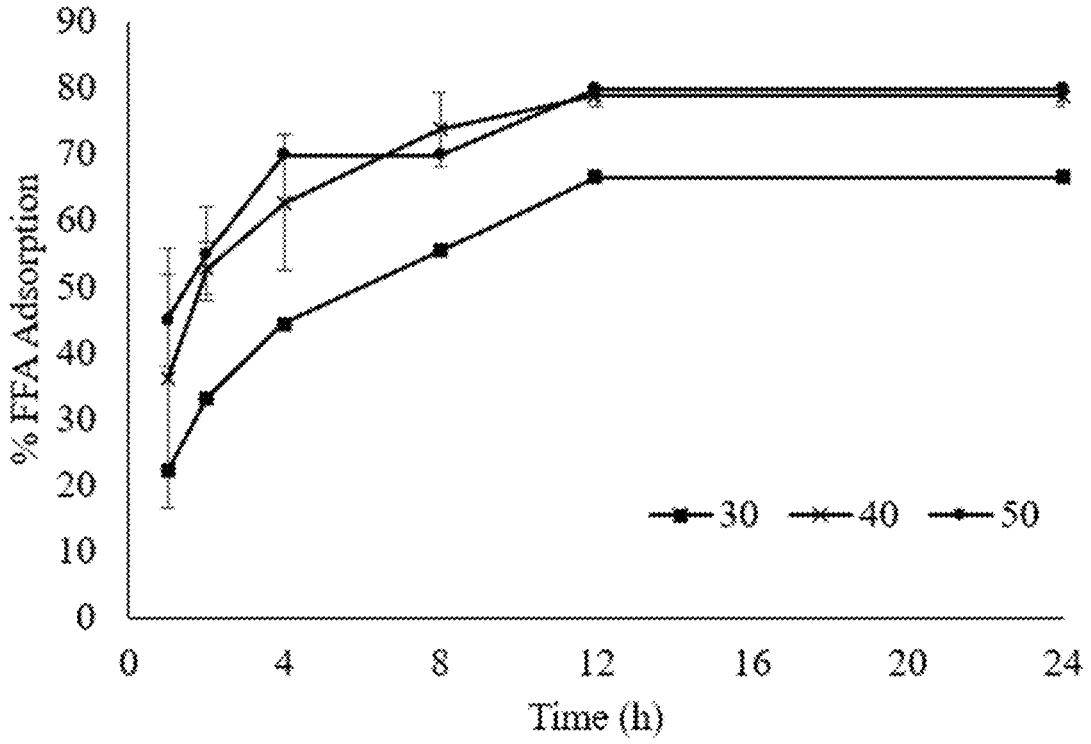
Figure 2:
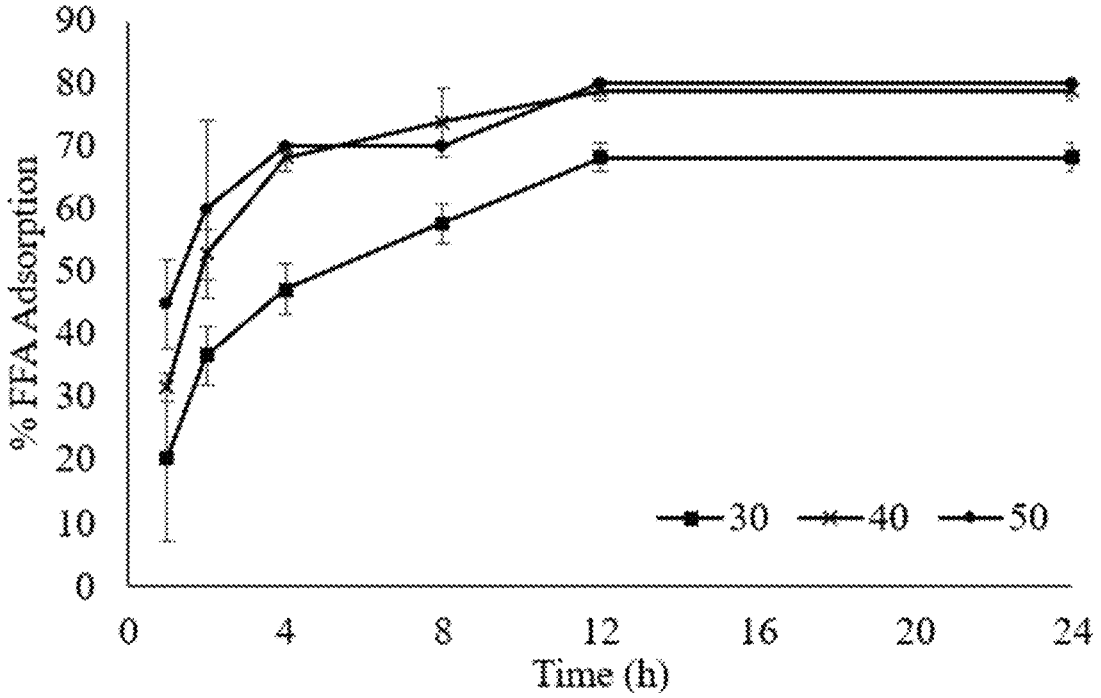

The effect of ion-exchange resin concentration on FFA adsorption was evaluated at 30° C. At a fixed FFA concentration, adsorbed FFA was positively correlated with ion-exchange resin concentration (Table 1). An ion-exchange resin concentration above 3% (w/w of oil) enabled greater than 50% recovery of FFA. As adsorption of FFA onto the ion-exchange resin forms hydrogen bonds, the reaction was run at three temperatures (30, 40 and 50° C.) at fixed FFA (2%) and ion-exchange resin (5%) concentrations. The effect of temperature on FFA adsorption is shown in FIG. 2. For palmitic acid (FIG. 2*a*), the highest adsorption (80%) occurred at 30° C. and decreased to 70-73% as the temperature was raised. Conversely, for C18 fatty acids (i.e., stearic acid (FIG. 2*b*) and oleic acid (FIG. 2*c*)) adsorption increased with rising temperature. In addition, the % FFA adsorption values for the C18 fatty acids were similar at 40 and 50° C. Studies of FFA adsorption using Indion 860 and Darco G 60 as adsorbents have reported differences in adsorption capacities of resin depending on degree of saturation. Saturated fatty acids, such as stearic acid, had greater specific adsorption onto resins compared to unsaturated fatty acids (i.e., oleic acid). It is argued that unsaturated bonds increase the affinity of fatty acids towards triglycerides (oil). Thus, the higher solubilization of unsaturated fatty acids in oil render them less available to adsorb onto the ion-exchange resin compared to saturated fatty acids. However, such differences in adsorption for fatty acids with equal carbon length was not observed in this study. As observed from the FIG. 2, a difference in adsorption capacity for fatty acid with equal carbon chain was only observed at 30° C. and not higher temperatures. The discrepancy in adsorption of stearic acid and oleic acid can be attributed to the presence of unsaturated bonds. The sorption properties of polystyrene-based matrix rely on hydrophobic interactions hence, the presence of π-electrons in oleic acid may increase its affinity towards the π-electron rich matrix of styrene divinylbenzene matrix of the ion-exchange resin. It can be argued that higher temperature would increase the solubility of fatty acids in triglycerides (oil), thereby decreasing the adsorption capacity, however, it was not observed as evident from the FIG. 2, except for the small decrease observed for palmitic acid. When using bentonite as an adsorbent, a decrease in adsorption capacity of stearic acid was observed with an increase in temperature.

TABLE 1

Effect of resin concentration on adsorption of FFA at fixed FFA concentration.

| Resin concentration | % FFA Adsorption | | |
|---|---|---|---|
| (% w/w) | Palmitic acid | Stearic acid | Oleic acid |
| 5.0 | 80.00 ± 0.01 | 66.67 ± 0.01 | 68.33 ± 2.36 |
| 4.0 | 71.36 ± 1.93 | 70.00 ± 0.01 | 72.22 ± 7.86 |
| 3.0 | 60.00 ± 0.01 | 57.78 ± 3.14 | 57.78 ± 3.14 |
| 2.0 | 45.45 ± 0.01 | 40.00 ± 0.01 | 44.44 ± 0.01 |
| 1.0 | 20.00 ± 0.01 | 15.56 ± 6.29 | 15.56 ± 6.29 |
| 0.5 | 9.55 ± 0.64 | 10.00 ± 0.01 | 10.00 ± 0.01 |

The refined oil was observed to become more viscous when FFA was added at 30° C. However, no apparent changes in flowability was noted at 40° C. Therefore, the reaction temperature was set at 40° C. to ensure good mass transfer of FFA between the liquid and solid phases. This data was next used to optimize the fatty acid and ion-exchange resin concentrations using a Full Factorial Design containing 3 levels.

Response surface methodology: To enable selection of a suitable ion-exchange resin concentration based on FFA concentration, the effects of FFA and resin concentrations on FFA adsorption was studies using a full factorial design. Results are listed in Table 2. It has been suggested that the ion-exchange resin and the adsorbate concentrations influence the extent of maximum adsorption. Hence, it was observed that at a fixed ion-exchange resin concentration, % FFA adsorption varied inversely with FFA concentration, possibly due to saturation of the ion-exchange resin active sites. As can be observed from Table 2, when the ratio of ion-exchange resin to FFA was above 3.75, about 90% of the added FFA was removed by the resin. Whereas at a ratio between 1.875-3.75 allowed for 70-80% adsorption. The regression analysis equation for the % FFA adsorbed at a specific resin and FFA concentration was:

$$\%\ \text{FFA adsorption} = 79.8 + 2.67(\text{Resin concentration}) - 8.19(\text{fatty acid concentration})$$

Figure 3:
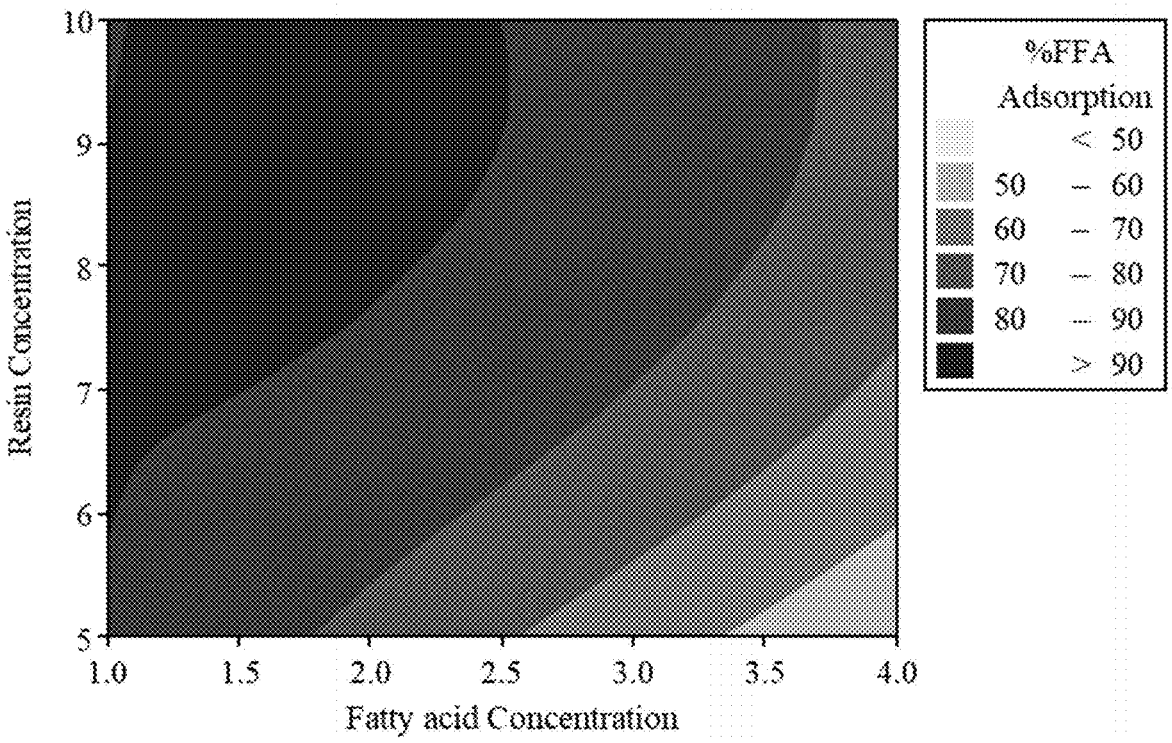
FIG. 3. Full factorial design analysis of FFA adsorption on Amberlite FPA51: (a) contour plot showing the percentage FFA adsorption at different resin and FFA concentration; (b) main effects plot; and (c) interaction plot.
Figure 3:
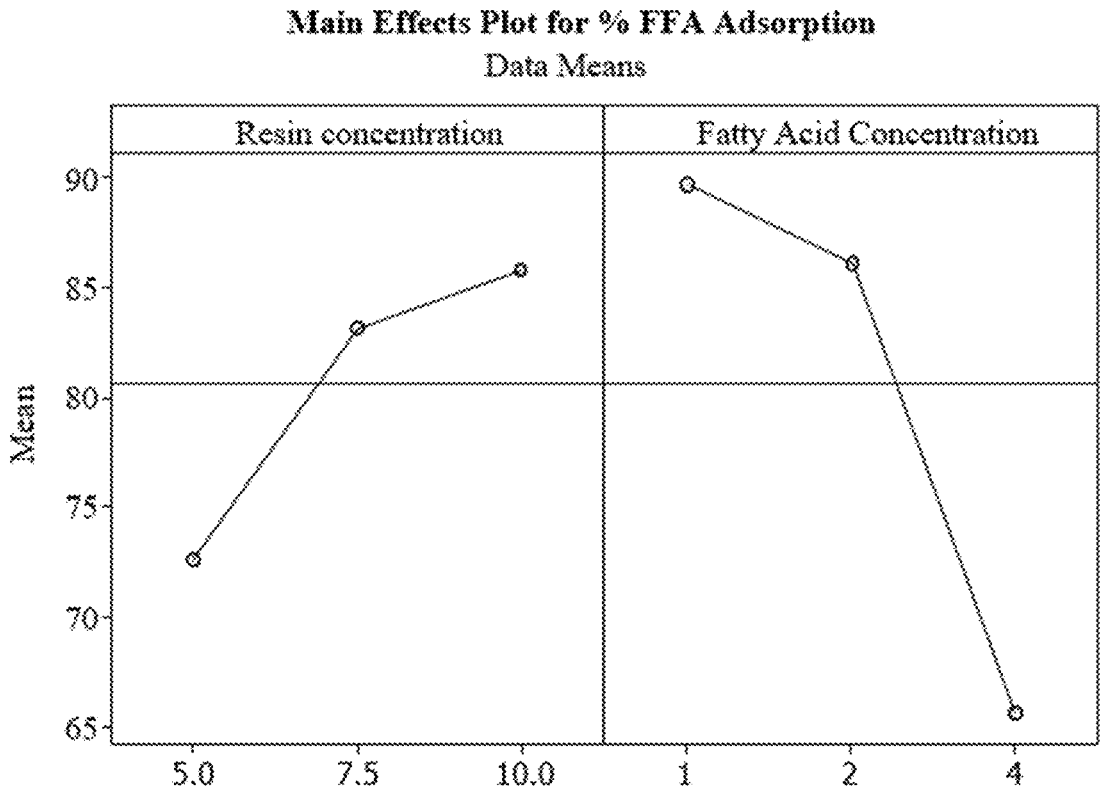
Figure 3:
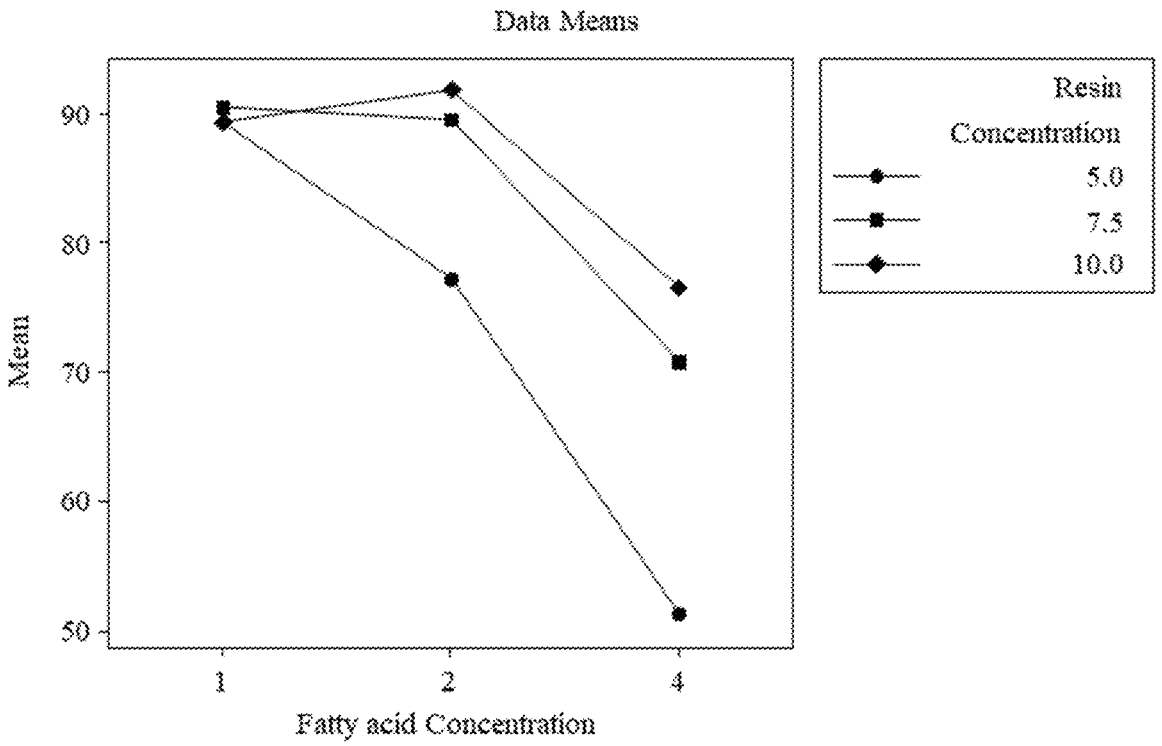

The % FFA adsorption at a given ion-exchange resin and FFA concentration can be predicted from the contour plot, as shown in FIG. 3*a*. The ANOVA of % FFA adsorption is as shown in Table 3. As observed both the individual variables, i.e., ion-exchange resin concentration and FFA concentration produced a significant influence on the % FFA adsorption ($P<0.05$). The $R^2$ and adjusted $R^2$ were 0.9940 and 0.9874, respectively, indicating a good fit between the predicted values and experimental results. The main effect and interactions plots are as shown in FIGS. 3*b* and 3*c*, respectively. The main effect plot demonstrates that ion-exchange resin and fatty acid concentrations had significant effects on adoption. As observed (FIG. 3*b*) % FFA adsorption rises with resin concentration from 5 to 7.5% w/w, and conversely a drastic decrease in % FFA adsorption occurs when the FFA concertation is raised from 2 to 4% w/w. The negative effect of an increase in fatty acid concentration on % FFA adsorption can also be observed in the regression analysis equation. The interaction plot (FIG. 3*c*) indicates only limited interaction between the variables, except when the fatty acid concentration is low (1% w/w). At lower FFA concentrations, the % adsorption is similar irrespective of the resin concentration, which may be due to greater availability of lone pair electrons within the resin as compared to acidic groups.

TABLE 3

ANOVA of % FFA adsorption.

| Source | DF | Seq SS | Adjusted SS | Adjusted MS | F | P |
|---|---|---|---|---|---|---|
| Blocks | 1 | 2.14 | 2.14 | 2.14 | 0.97 | 0.354 |
| Resin Concentration | 2 | 596.71 | 596.71 | 589.35 | 134.72 | 0.000 |
| Fatty acid Concentration | 2 | 2018.93 | 2018.93 | 1009.46 | 455.83 | 0.000 |
| Resin:FFA | 4 | 340.75 | 340.75 | 85.19 | 38.47 | 0.000 |
| Error | 8 | 17.72 | 17.72 | 2.21 | | |
| Total | 17 | 2976.25 | | | | |
| $R^2$ | 0.9940 | | | | | |
| Adjusted $R^2$ | 0.9874 | | | | | |

TABLE 4

Observed correlation coefficient for different adsorption kinetic of evaluated fatty acids.

| Model | Plot | Fatty acid | $R^2$ | k (1/units) | Experimental $q_e$ (mg/g) | Calculated $q_e$ (mg/g) |
|---|---|---|---|---|---|---|
| pseudo-first order | log ($q_e$-$q_t$) vs t | palmitic acid | 0.8829 | −0.004 | 240 | 263.4 |
| | | stearic acid | 0.9915 | −0.0026 | 222.2 | 234.4 |
| | | oleic acid | 0.974 | −0.0018 | 273.33 | 284.8 |
| pseudo-second order | t/$q_t$ vs t | palmitic acid | 0.9965 | 0.0029 | 240 | 226.9 |
| | | stearic acid | 0.9911 | 0.0035 | 222.22 | 236.2 |
| | | oleic acid | 0.9829 | 0.0034 | 273.33 | 254.1 |
| Elovich kinetic model | $q_t$ vs ln t | palmitic acid | 0.967 | 58.537 | 240 | 218.7 |
| | | stearic acid | 0.965 | 60592 | 222.2 | 219.4 |
| | | oleic acid | 0.9565 | 62.817 | 273.33 | 252.5 |

TABLE 2

Experimental Design and results for optimization of FFA adsorption.

| Resin Concentration (%) | FFA Stock Concentration (% w/v) | Ratio (Resin:FFA) (w:w) | % FFA Adsorption Experimental Value | % FFA Adsorption Modelled Value |
|---|---|---|---|---|
| 5.0 | 2 | 2.5 | 76.47 | 76.78 |
| 5.0 | 1 | 5.0 | 88.89 | 89.10 |
| 7.5 | 4 | 1.875 | 67.74 | 69.24 |
| 10.0 | 4 | 2.5 | 75.76 | 76.10 |
| 10.0 | 1 | 10.0 | 88.89 | 89.09 |
| 10.0 | 2 | 5.0 | 93.75 | 91.53 |
| 5.0 | 2 | 2.5 | 77.78 | 77.47 |
| 7.5 | 1 | 7.5 | 90.91 | 90.11 |
| 10.0 | 1 | 10.0 | 90.00 | 89.79 |
| 7.5 | 2 | 3.75 | 89.47 | 89.82 |
| 5.0 | 1 | 5.0 | 90.00 | 89.79 |
| 7.5 | 2 | 3.75 | 89.47 | 89.13 |
| 10.0 | 4 | 2.5 | 77.14 | 76.79 |
| 10.0 | 2 | 5.0 | 90.00 | 92.22 |
| 5.0 | 4 | 1.25 | 52.27 | 51.48 |
| 5.0 | 4 | 1.25 | 50.00 | 50.79 |
| 7.5 | 4 | 1.875 | 71.43 | 69.93 |
| 7.5 | 1 | 7.5 | 90.00 | 90.79 |

Recovery of adsorbed FFA and reuse of ion-exchange resin: It has been suggested that solubility of vegetable oils in ethanol is dependent on the solvent concentration and the temperature used for solubilization. Moreover, at room temperature, vegetable oils are poorly soluble, even in absolute alcohol (less than 10 g/100 g ethanol). Also, C18 fatty acids (i.e., stearic acid) are soluble in ethanol under ambient conditions. Hence, in this study, ethanol was used to recover the FFA dissolved in residual oil (recovered after hexane evaporation). Using ethanol, 86.55±5.19% of the adsorbed FFA was recovered, which equates to 67.55±4.05% of the FFA initially present. Therefore, use of two-stage recovery process, using hexane and ethanol, will enable recovery of all the oil and most of the added FFA. The recovered oil can be blended into the purified oil, thereby preventing loss of oil for biodiesel production. Further, the recovered FFA can be upgraded to value-added products.

Figure 4:
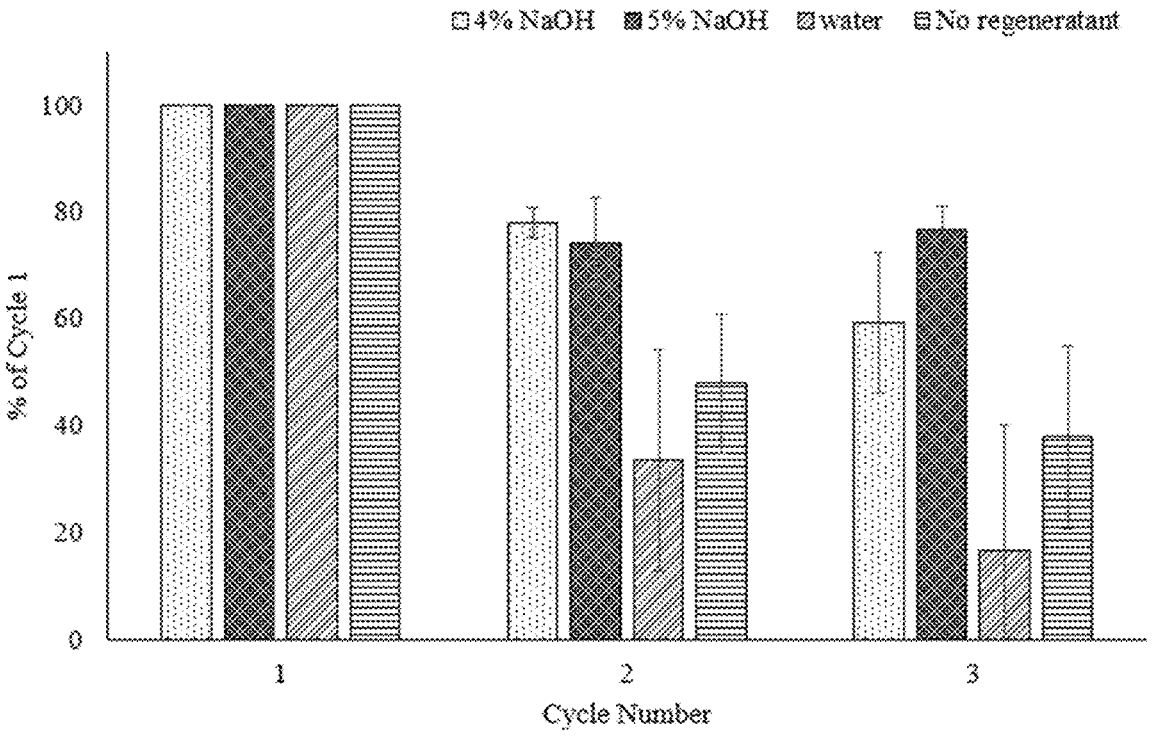
FIG. 4. Regeneration and reusability of Amberlite FPA51 for FFA adsorption in subsequent cycles.

Ion-exchange resin are susceptible to chemical or physical deactivation or neutralization of their active sites. However, an advantage of using ion-exchange resins is the ability to recover their ion-exchange capabilities by using regenerants, so that they can be reused for multiple cycles. For Amberlite FPA-51, the manufacturer recommends regenerating with 4% NaOH for a minimum of 30 min. In this study, NaOH (4 and 5% w/v) and water were tested as potential regenerant. After regeneration, the ion-exchange resin was reused for subsequent cycle of adsorption by using fresh FFA oil mixture. The results of regeneration and reusability is depicted in FIG. 4. As expected, water was ineffective at regenerating the active sites and the decrease in % FFA adsorption was similar to that observed when no regenerant was used. With 4% NaOH as regenerant, the % FFA adsorption in cycle 2 was 78% of cycle 1 (fresh resin), which subsequently decreased to 59% in cycle 3. Whereas, when 5% NaOH was used as regenerant, the % FFA adsorption in cycle 2 was observed to be 75% of cycle 1 and remained similar in cycle 3. Thus, it can be concluded that regenerating with 5% NaOH performed better than 4% NaOH, presumably, by enabling the recovery of active sites. It has been observed that the regeneration process allows recovery of about 60-80% of the ion-exchange resin capacity, which agrees with our results. The reason for the decrease in % FFA adsorption can be attributed to inefficient generation of active sites as well as loss of resin particle size and sphericity. During the regeneration process, a fraction of resin was damaged resulting in presence of powder as well as spherical resin. This loss in particle size may negatively impact active sites and thus reduce adsorption capacity. Commercially, ion-exchange resins are used within column beds, which should minimize mechanical damage of the resin, thereby improving reusability. Although, the % FFA adsorbed decreased with ion-exchange resin reuse, fresh ion-exchange resin can be added to make up for lost adsorption capacity. Minimizing resin consumption is important for controlling costs and it is expected that loss of capacity will be reduced by switching to a fixed bed reactor.

Figure 5:
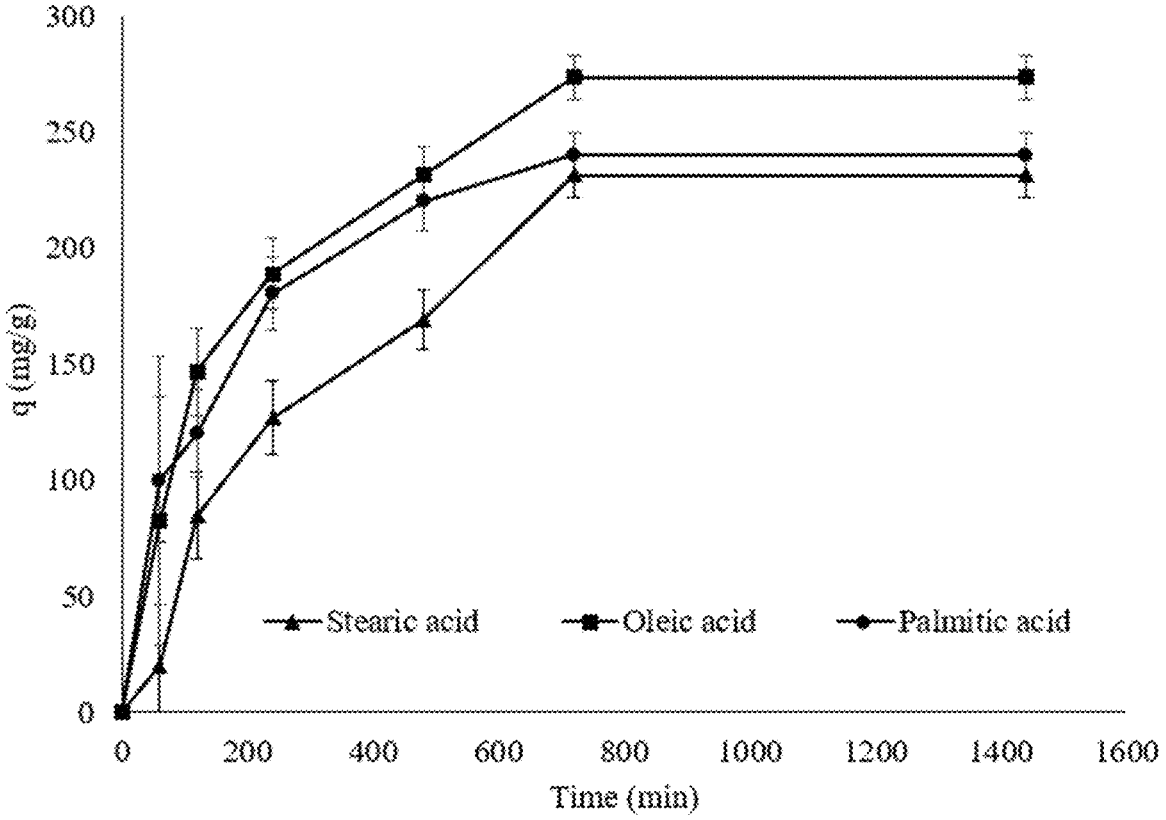
FIG. 5. Kinetic study (a) adsorption kinetics of palmitic acid, stearic acid, and oleic acid on Amberlite FPA51 at 40° C.; (b) pseudo-first order kinetic model; (c) pseudo-second order kinetic model; and (d) Elovich kinetic model. Data are expressed as average values±s.d.
Figure 5:
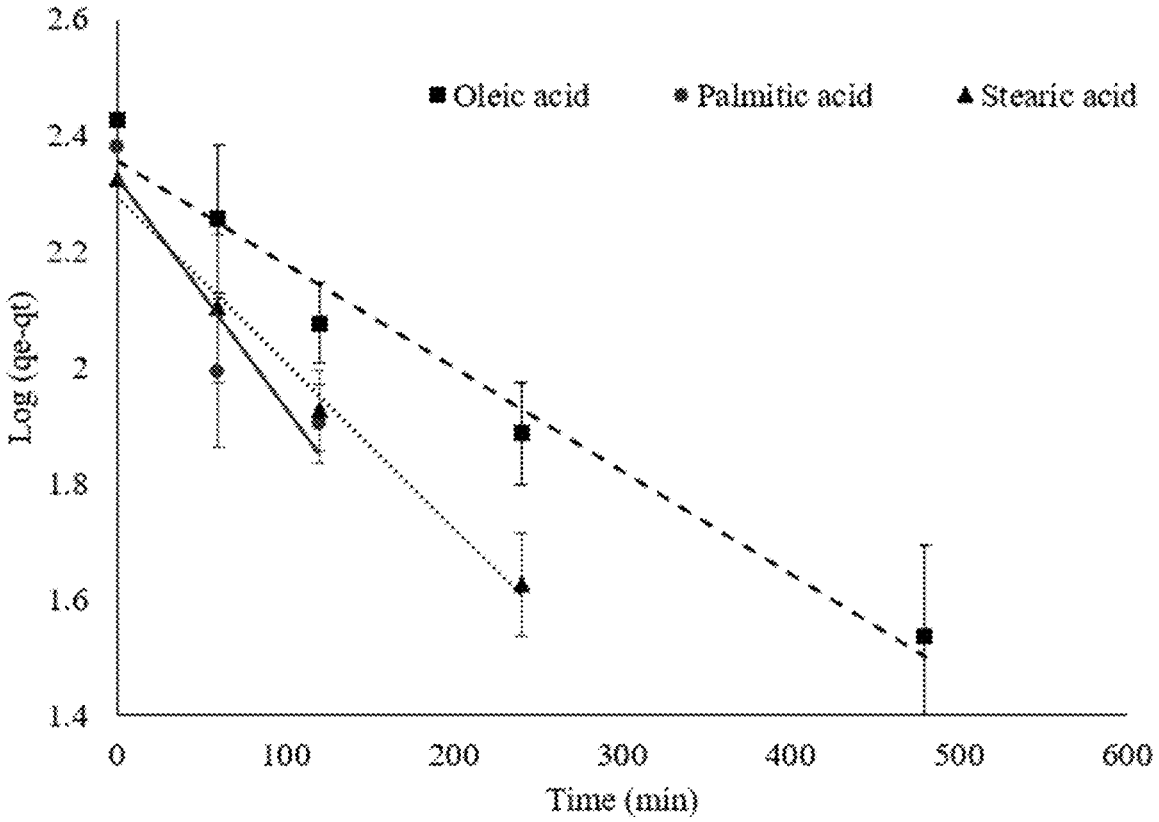
Figure 5:
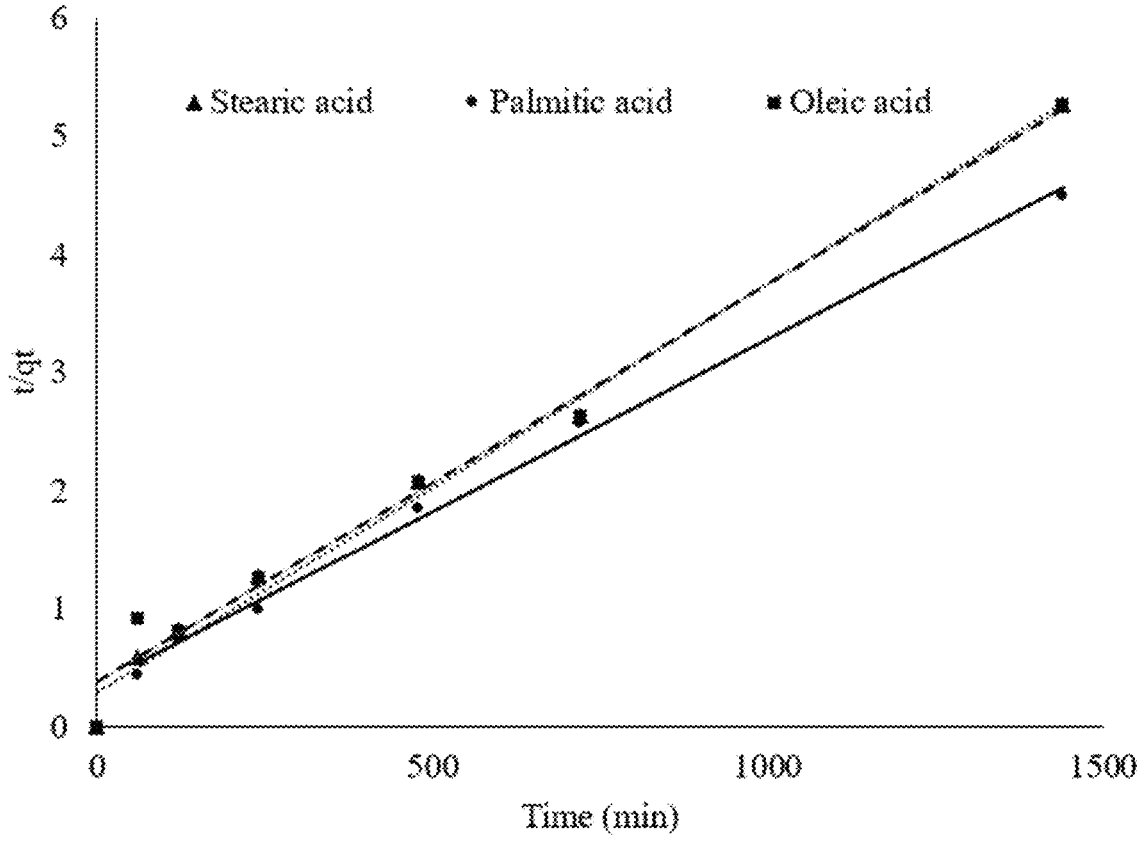
Figure 5:
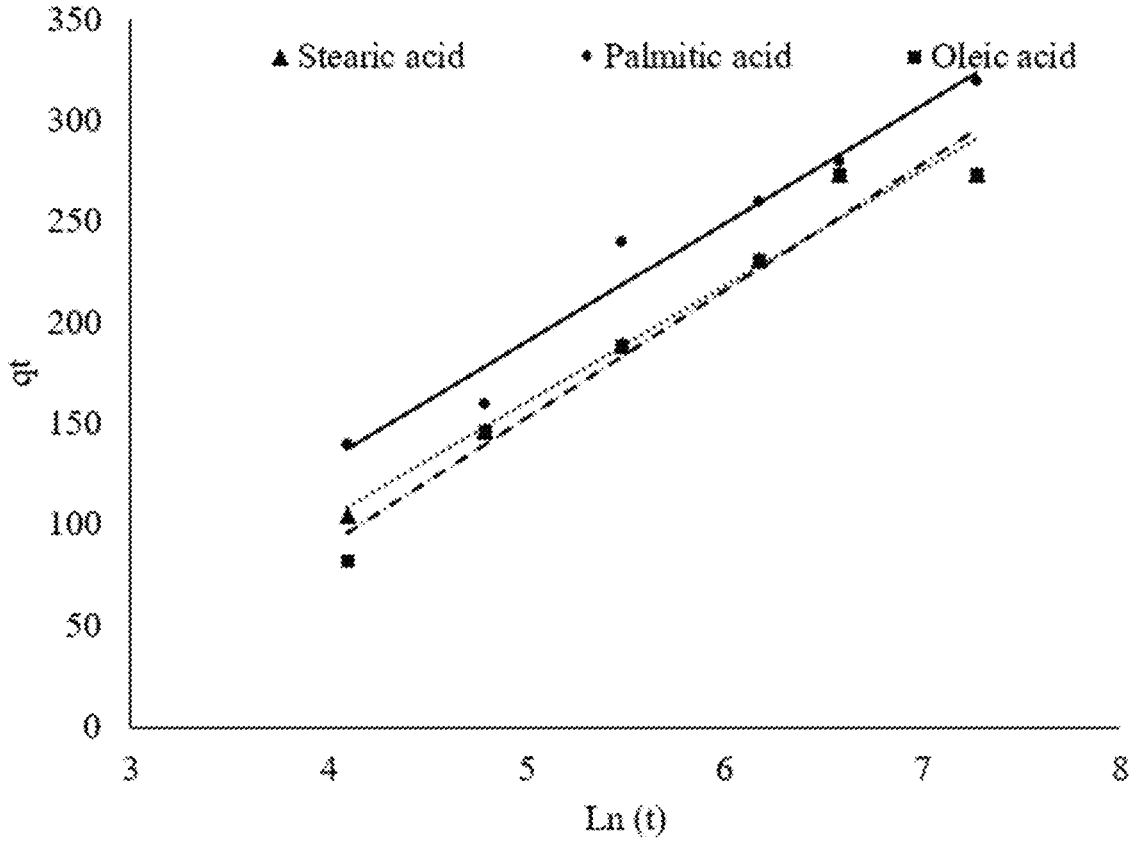

Adsorption Kinetic Model:

The rate and time to achieve equilibrium for adsorption of individual fatty acids was measured for Amberlite. The adsorption kinetics are presented as the amount of fatty acid adsorbed per gram of ion-exchange resin (q) with time (FIG. 5*a*). The adsorption of fatty acids onto the ion-exchange resin involves interaction of the lone pair of electrons of the amine active group of ion-exchange resin and the acidic hydrogen of fatty acids. Therefore, initially when all the lone pair of electrons are available, the adsorption is seen to increase with time until with the lone pair electron sites are saturated with bond acidic FFA. Equilibrium is reached after 800 min. At equilibrium, the adsorption capacities of Amberlite FPA51 were observed to be 240 mg/g, 231 mg/g and 273 mg/g of resin for palmitic, stearic and oleic acids, respectively. On a molar basis, at equilibrium 0.94 moles, 0.81 moles and 0.97 moles of palmitic acid, stearic acid and oleic acid, respectively, were adsorbed per gram of resin. The maximum adsorption capacity observed here is similar to that reported for oleic acid using Amberlite MB-150 (270 mg/g) and Dowex Monosphere MR-450 UPW (260 mg/g). The data for adsorption of fatty acids onto ion-exchange resin was fitted using pseudo-first order, pseudo-second order or Elovich kinetic model. The pseudo-first order, pseudo-second order and Elovich kinetic model can be represented by the equation 1, 2 and 3, respectively:

$$\log(q_e - q_t) = \log q_e - k_d t / 2.303$$

$$\frac{t}{q_e} = \frac{1}{k_2 q_e^2} + \frac{1}{q_e} t$$

$$q_t = \beta \ln \alpha\beta + \ln t$$

where, $q_e$ and $q_t$ represents amount of fatty acid adsorbed (mg/g of resin) at equilibrium and at time t, respectively, $k_d$ ($min^{-1}$) is the pseudo-first-order rate constant, $k_2$ is the pseudo-second order rate constant (mg/g·min), β is the desorption constant (g/mg) and α is the initial adsorption rate (mg/g·min). The rate constants and correlation coefficients are listed in the Table 4 and plots graphed in the FIG. 5. Among the evaluated kinetic models, pseudo-first order and pseudo-second order had $R^2$ of 0.88-0.99, which indicated they are good choices for explaining the adsorption behavior of tested fatty acids on Amberlite FPA-51.

Ion exchange resins containing strong base or weak base as active group were evaluated for their effectiveness to adsorb FFA dissolved in refined soy oil. It was observed that the weak base ion-exchange resin Amberlite FPA-51, which possesses secondary amine functional groups, removed the most FFA. Further study indicated that 8 h was required to reach adsorption equilibrium. The full factorial design used to optimize the ion-exchange resin and fatty acid concentrations will also allow the ion-exchange resin concentration to be set based upon the beginning and target FFA concentrations. The resin was regenerated by treating with 5% NaOH for 45 min. Although the regeneration process did not restore 100% of the adsorption capacity, the ion-exchange resin could be used for at least 3 consecutive cycles, which reduces ion-exchange resin consumption and cost. Furthermore, washing with ethanol recovered 86.55±5.19% of the adsorbed FFA. Thus, in this work, an optimized process was developed for separation and recovery of FFA from oil. The developed process can be applied for reducing the free fatty acid content of waste cooking oil and other sources containing an undesirable concentration of FFA for biodiesel production. In addition, the recovered FFA can be upgraded to value-added products to improve the economics of the biodiesel production.

The following Examples are intended to illustrate the above invention and should not be construed as to narrow its scope. One skilled in the art will readily recognize that the Examples suggest many other ways in which the invention could be practiced. It should be understood that numerous variations and modifications may be made while remaining within the scope of the invention.

EXAMPLES

Example 1. Materials

Palmitic acid (>96%) was procured from Chem Impex, Illinois, USA. Stearic acid (>98%) and Oleic acid (>85%) were procured from TCI America, Oregon, USA and used without further purification. Ethanol (190 proof) was obtained from Decon Labs Inc, Pennsylvania, USA, Phenolphthalein (0.5 wt % in ethanol:water, 1:1) was obtained from Millipore Sigma, Wisconsin, USA, and Potassium hydroxide pellets were obtained from Millipore Sigma, Wisconsin, USA. Refined soybean oil was procured from local grocery store in Urbana, Ill., USA. Ion-exchange resins Amberlite IRA 400 CL™ and base Amberlite IRA 96™ were procured from Millipore Sigma, Wisconsin, USA whereas Amberlite FPA 90 CL™ and Amberlite FPA 51™ were obtained from The Dow Company, Michigan, USA. The properties of the resins are listed in Table 5 (obtained from manufacturer sites).

TABLE 5

Properties of the resins used in this study.

| Property | Amberlite IRA 400 Cl | Amberlite FPA 90 Cl | Amberlite IRA 96 | Amberlite FPA 51 |
|---|---|---|---|---|
| Copolymer | Styrene-divinylbenzene | Styrene-divinylbenzene | Styrene-divinylbenzene | Styrene-divinylbenzene |
| Matrix | Gel | Macroporous | Macroporous | Macroporous |
| Type | Strong base anion, Type II | Strong base anion, Type I | Weak base anion | Weak base anion |
| Functional Group | Dimethylethanolammonium | Quaternary ammonium | Tertiary amine | Secondary amine (≥85%) |
| Physical Form | Pale yellow, translucent, spherical beads | Off-white, opaque, spherical beads | White to tan, opaque, spherical beads | Beige, opaque, spherical beads |
| Ionic form | $Cl^-$ | $Cl^-$ | Free base (FB) | FB |
| Total Exchange capacity | ≥1.25 eq/L | ≥1.00 eq/L | ≥1.30 eq/L | ≥1.30 eq/L |
| Particle diameter | 600-750 μm | 65-820 μm | 550-750 μm | 490-690 μm |
| Uniformity Coefficient | ≤1.60 | — | ≤1.60 | — |
| Swelling | 20% ($Cl^-$ to $OH^-$) | 25% ($Cl^-$ to $OH^-$) | 15% (FB to HCl) | 25% (FB to HCl) |
| Water Retention capacity | 45-51% | 58-64% | 59-65 | 56-62% |

Example 2. Adsorption Study Using Certain Embodiments of the Invention

Identification of suitable ion-exchange resins: Adsorption of palmitic acid, stearic acid and oleic acid was evaluated for four ion-exchange resins to identify the best for FFA adsorption. The resins were washed and activated by mixing them with ethanol for 4 h at 30° C., 180 rpm. The washed ion-exchange resins were dried at 49° C. for 12 h in a forced air convection oven. For the adsorption study, a known amount of individual fatty acid (% w/w of oil) was dissolved in refined soybean oil and then mixed with a specific amount of resin (% w/w of oil) and incubated (C24 incubator Shaker, New Brunswick Scientific, USA) at 30° C., 180 rpm for 4 h. At regular interval, an aliquot (1 g) was withdrawn and used to measure the acid value. The acid value was determined by titration using 0.05M KOH with phenolphthalein as indicator. Briefly, the aliquot was dissolved in 20 ml neutralized ethanol and warmed to first bubble. The warm mixture was titrated with KOH in presence of phenolphthalein and the volume of titrant consumed was noted at the endpoint (colorless to faint pink). The molarity of KOH was adjusted to obtain a quantitative titration reading to prevent experimental errors.

Effect of ion-exchange resin concentration and temperature on FFA adsorption: The ion-exchange resin enabling maximum adsorption and separation of FFA from oil was selected to determine the effect of ion-exchange resin concentration (0.5, 1, 2, 3, 4, 5% w/w of oil) on adsorption of FFA at a fixed FFA concentration. Briefly, known amount of ion-exchange resin was added to the oil and incubated at 30° C. for 24 h. At regular intervals, an aliquot was withdrawn and used to measure Acid Value. The effect of temperature (30, 40 and 50° C.) on adsorption of FFA onto ion-exchange resin was evaluated at a fixed FFA (2%) and ion-exchange resin concentration (5%). Briefly, the mixture was incubated at desired temperature and an aliquot was withdrawn periodically to estimate the Acid Value.

Recovery of Adsorbed FFA and ion-exchange resin reusability: At the end of incubation period, the ion-exchange resins were separated from oil mixture by vacuum filtration using a sintered glass funnel. The recovered ion-exchange resins were then washed with hexane (10 ml) for 5 min to recover the adsorbed FFA and the adhering oil. The hexane layer was evaporated to recover the residual oil containing the FFA. To the residual oil, ethanol was added and mixed for 5 min, after which the mixture was centrifuged. The top ethanol layer was separated from the oil layer and evaporated to recover the adsorbed FFA. To evaluate the reusability of ion-exchange resin, the hexane washed resin was regenerated and used for subsequent cycles. The regenerant used in this study includes 5% NaOH, 4% NaOH and water. The washed ion-exchange resin was mixed with the regenerant for 45 minutes and filtered to recover the ion-exchange resin. For the subsequent cycles, the regenerated ion-exchange resin was mixed with new batch of FFA containing oil. The Acid Value was determined at the end of adsorption process (24 h) and related to % FFA Adsorption. The % FFA adsorption in consecutive cycles were referenced to that obtained in cycle 1, which was considered as 100%.

Design of experiment and statistical analysis: Based on results of this work, a full factorial design (FFD) of experiment was designed by varying the concentration of ion-exchange resin and FFA to maximize FFA adsorption. The FFD was developed using Minitab Statistical Software Version 16 (Pennsylvania State University, USA) for optimizing and evaluating the effect of the two independent process variables i.e., ion-exchange resin concentration ($X_1$) and FFA concentration ($X_2$) on the dependent factor, i.e., FFA adsorption. The adsorption experiments were conducted at a fixed temperature (40° C.). The independent variables were varied over 3 level to represent low, medium and high level. The independent variables include ion-exchange resin concentration (5, 7.5 and 10% w/w of oil) and FFA concentration (1, 2, and 4% w/w of oil). A total of 18 experiments were performed in a random order. The adsorption process was continued for 24 h and the acid value was determined to estimate % FFA adsorption. The Minitab software was used to conduct the ANOVA and generate the main and the interaction plots.

Example 3. Exemplary Protocol for Use of an Embodiment of the Invention

Step 1: the resin Amberlite FPA-51 is washed with alcohol for at least 3 h (this is standard process of ion-exchange resin activation, where the ion-exchange resins are washed to activate the functional groups)

Step 2: The ion-exchange resin is then mixed with oil containing the fatty and incubated for 24 h, 150 rpm, 40° C.

Step 3: At the end of incubation period the mixture was filtered using sintered funnel to separate the ion-exchange resin and the oil. Vacuum was applied to ascertain that the oil is filtered while retaining the ion-exchange resin.

Step 4: The retained ion-exchange resin was washed with n-hexane (15-20 ml) to ensure that all adhering oil and adsorbed fatty acid is dissolved and recovered.

Step 5: The hexane layer is then evaporated to recover the oil (residual) containing the fatty acid (concentrated). The hexane can be reused for step 4.

Step 6: The residual oil containing the fatty acid (obtained in step 5) was mixed with ethanol (20 ml). The mixture was centrifuged to obtain two layers and the top ethanol layer was collected. This step was performed twice. Ethanol helps to solubilize fatty acid while leaving behind the oil (triglycerides).

Step 7: The ethanol layer is evaporated to recover the fatty acids. The ethanol can be reused in step 6.

Step 8: The washed ion-exchange resin (obtained after hexane washing in step 4) is incubated with 5% sodium hydroxide for 45 min, 30° C., 150 rpm to activate the functional group on the ion-exchange resin. The alkali washed ion-exchange resin was rinsed with water and reused (as in step 2).

While specific embodiments have been described above with reference to the disclosed embodiments and examples, such embodiments are only illustrative and do not limit the scope of the invention. Changes and modifications can be made in accordance with ordinary skill in the art without departing from the invention in its broader aspects as defined in the following claims.

All publications, patents, and patent documents are incorporated by reference herein, as though individually incorporated by reference, and in particular, U.S. Pat. No. 9,045,712. No limitations inconsistent with this disclosure are to be understood therefrom. The invention has been described with reference to various specific and preferred embodiments and techniques. However, it should be understood that many variations and modifications may be made while remaining within the spirit and scope of the invention.

What is claimed is:

1. A method for separating free fatty acids (FFA) from crude oil containing FFA comprising:

a) contacting an ion-exchange resin with a first alcohol to activate the ion-exchange resin;

b) drying the ion-exchange resin to provide an activated ion-exchange resin;

c) mixing the activated ion-exchange resin with the crude oil to form a mixture, wherein the mixture comprises the crude oil and the ion-exchange resin, and the ratio of the activated ion-exchange resin and the FFA in the mixture is about 10:1 w/w to about 1.875:1 w/w;

d) incubating the mixture to adsorb FFA from the crude oil onto the activated ion-exchange resin;

e) filtering the mixture to form a treated oil and a separated ion-exchange resin comprising the adsorbed FAA and residual oil;

f) washing the separated ion-exchange resin with a non-polar solvent to partition the residual oil from the separated ion-exchange resin to provide a washed ion-exchange resin and a first FFA fraction, wherein the first FFA fraction comprises the non-polar solvent, the residual oil, and desorbed FFA;

g) evaporating the non-polar solvent from the first FFA fraction to provide a second FFA fraction comprising the residual oil and the desorbed FFA;

h) combining a second alcohol with the second FFA fraction to separate the desorbed FFA from the residual oil; and i) removing the second alcohol from the residual oil in the second FFA fraction, wherein the second alcohol comprises the desorbed FFA;

wherein a FFA content of less than 3% w/w remains in the treated oil.

2. The method of claim 1 further comprising reactivating the washed ion-exchange resin with aqueous sodium hydroxide to reactivate functional groups of the washed ion-exchange resin.

3. The method of claim 1 wherein the ion-exchange resin comprises a styrene-divinylbenzene co-polymer.

4. The method of claim 3 wherein the ion-exchange resin comprises a weakly basic ion-exchange resin comprising secondary or tertiary amine functional groups.

5. The method of claim 1 wherein the first alcohol and the second alcohol are methanol, ethanol, propanol, isopropyl alcohol, butanol, or a combination thereof.

6. The method of claim 1 wherein the treated oil comprises about 1% w/w or less of free fatty acid content.

7. The method of claim 1 wherein the ratio of the activated ion-exchange resin to the FFA in the mixture is about 5:1 w/w to about 1.875:1 w/w.

8. The method of claim 1 wherein the mixture comprises about 0.5% w/w to about 15% w/w of the activated ion-exchange resin.

9. The method of claim 8 wherein the mixture comprises about 2% w/w to about 7.5% w/w of the activated ion-exchange resin.

10. The method of claim 1 wherein the non-polar solvent is pentane, hexane, heptane, benzene, toluene, xylene, chloroform, diethyl ether, ethyl acetate, or pyridine.

11. The method of claim 1 wherein the crude oil is vegetable oil, waste cooking oil, or an oil from vegetative tissue.

12. A method for separating and recovering free fatty acids (FFA) from vegetable oil or waste cooking oil containing FFA comprising:

a) activating an ion-exchange resin with a first ethanol for about 1 hour to about 4 hours at about 25° C. to about 35° C. with agitation;

b) drying the ion-exchange resin for about 2 hours to about 12 hours at about 45° C. to about 55° C. to provide an activated ion-exchange resin;

c) mixing the activated ion-exchange resin with vegetable oil or waste cooking oil to form a mixture, wherein the mixture comprises the vegetable oil or the waste cooking oil and the activated ion-exchange resin, and the ratio of the activated ion-exchange resin and the FFA in the mixture is about 10:1 w/w to about 1.875:1 w/w;

d) incubating the mixture for about 4 hours to about 8 hours at about 35° C. to about 45° C. to adsorb FFA from the vegetable oil or the waste cooking oil to the activated ion-exchange resin;

e) filtering the mixture to form a treated oil and a separated ion-exchange resin comprising the adsorbed FAA and residual oil;

f) washing the separated ion-exchange resin with hexane to partition the residual oil from the separated ion-exchange resin to provide a washed ion-exchange resin and a first FFA fraction, wherein the first FFA fraction comprises the hexane, the residual oil, and desorbed FFA;

g) evaporating the hexane from the first FFA fraction to provide a second FFA fraction;

h) combining a second ethanol fraction with the second FFA fraction to separate the desorbed FFA from the residual oil remaining in the second FFA fraction;

i) removing the second ethanol from the second FFA fraction, wherein the second ethanol comprises the FFA; and j) evaporating the second ethanol fraction to recover the desorbed FFA;

wherein a free fatty acid content of less than 3% w/w remains in the treated oil.

13. The method of claim 12 further comprising rinsing the separated ion-exchange resin from step f with an aqueous sodium hydroxide solution for about 20 minutes to about 90 minutes at about 25° C. to about 35° C. with agitation to reactivate functional groups of the separated ion-exchange resin to provide a refreshed ion-exchange resin.

14. The method of claim 13 wherein the refreshed ion-exchange resin is used in a subsequent separation reaction to provide vegetable oil or waste cooking oil with less than 3% FFA, recovered FFA, or both vegetable oil or waste cooking oil with less than 3% FFA and recovered FFA.

15. The method of claim 12 wherein the mixture comprises about 2% w/w to about 7.5% w/w of the activated ion-exchange resin.

16. The method of claim 12 wherein the ion-exchange resin comprises a weakly basic styrene-divinylbenzene copolymer, and the weakly basic styrene-divinylbenzene copolymer comprises secondary amine functional groups, tertiary amine functional groups, or both secondary and tertiary amine functional groups.

17. The method of claim 12 wherein the treated oil comprises less than 1% w/w FFA content.

* * * * *